US010851565B1

(12) United States Patent
Krueger

(10) Patent No.: US 10,851,565 B1
(45) Date of Patent: Dec. 1, 2020

(54) ROTARY LOCK ACTUATOR

(71) Applicant: Dale R. Krueger, Woodstock, IL (US)

(72) Inventor: Dale R. Krueger, Woodstock, IL (US)

(73) Assignee: Questek Manufacturing Corporation, Elgin, IL (US)

( * ) Notice: Subject to any disclaimer, the term of this patent is extended or adjusted under 35 U.S.C. 154(b) by 492 days.

(21) Appl. No.: 15/922,638

(22) Filed: Mar. 15, 2018

Related U.S. Application Data

(60) Provisional application No. 62/471,508, filed on Mar. 15, 2017.

(51) Int. Cl.

| | |
|---|---|
| ***E05B 81/06*** | (2014.01) |
| ***E05B 81/30*** | (2014.01) |
| ***E05B 81/34*** | (2014.01) |
| ***E05B 85/24*** | (2014.01) |
| ***E05B 81/90*** | (2014.01) |
| *E05B 47/00* | (2006.01) |
| *E05B 15/04* | (2006.01) |

(52) U.S. Cl.
CPC ..... *E05B 81/06* (2013.01); *E05B 81/30* (2013.01); *E05B 81/34* (2013.01); *E05B 81/90* (2013.01); *E05B 85/24* (2013.01); *E05B 2015/0493* (2013.01); *E05B 2047/0024* (2013.01)

(58) Field of Classification Search
CPC ..... E05B 47/0012; E05B 2047/002; E05B 2047/0086; E05B 47/026; E05B 47/068; E05B 47/0001; E05B 15/00; E05B 63/08; Y10T 70/7107; Y10T 292/1021; Y10T 292/1082; Y10T 70/5319; Y10T 70/7073; Y10T 292/096
See application file for complete search history.

(56) References Cited

U.S. PATENT DOCUMENTS

| | | | | |
|---|---|---|---|---|
| 4,685,709 | A * | 8/1987 | Kambic | E05B 47/0012 292/201 |
| 5,718,135 | A * | 2/1998 | Bertenshaw | E05B 47/0012 292/44 |
| 7,373,795 | B2 * | 5/2008 | Kilbourne | E05B 47/0012 70/278.1 |
| 2007/0157684 | A1 * | 7/2007 | Bogdanov | E05B 47/0692 70/279.1 |
| 2010/0212381 | A1 * | 8/2010 | Huang | E05B 47/068 70/279.1 |

(Continued)

*Primary Examiner* — Mark A Williams
(74) *Attorney, Agent, or Firm* — Cook Alex Ltd.

(57) ABSTRACT

A rotary lock actuator for manual or powered actuation of a lock for vehicle doors is disclosed. The actuator has a motorized drive train and an actuating member movable between first and second positions. A manual drive member and a powered drive member each have first and second drive surfaces spaced apart from one another. A drive wedge is disposed in the spaces between the first and second drive surfaces of each drive member such that the drive wedge is engageable with the actuating member. The first driving surface of each drive member engages the wedge for moving the actuating member from a first position toward a second position upon movement of one of the drive members. The drive wedge is engageable by the second driving surface of each drive member for moving the actuating member from a second position toward the first position upon movement a drive member.

11 Claims, 27 Drawing Sheets

(56) References Cited

U.S. PATENT DOCUMENTS

2011/0259059 A1* 10/2011 Wu ..... E05B 63/0017
70/91
2012/0025984 A1* 2/2012 Lu ..... E05B 47/0657
340/542
2013/0167598 A1* 7/2013 Huang ..... F16H 19/02
70/278.1
2013/0167671 A1* 7/2013 Huang ..... F16H 19/02
74/25
2013/0168978 A1* 7/2013 Huang ..... E05B 47/068
292/336.3
2013/0192317 A1* 8/2013 McKibben ..... E05B 49/00
70/278.1
2014/0250956 A1* 9/2014 Chong ..... G07C 9/00174
70/278.1
2017/0370127 A1* 12/2017 Huang ..... E05B 47/026

* cited by examiner

ROTARY LOCK ACTUATOR

CROSS REFERENCE TO RELATED APPLICATION

This application claims the benefit of U.S. Application Ser. No. 62/471,508, filed Mar. 15, 2017, the disclosure of which is incorporated herein by reference.

BACKGROUND

The present subject matter generally relates to an actuator for manual or powered actuation of a locking device of the type having a lock cylinder and a locking member.

Traditionally, locking devices have been operated and controlled manually by a key. However, recently the use of powered or electronic systems to control locking devices is becoming increasingly common. The electronic control of such of devices such as locks can be a great convenience and time saver for a user. For example, the advent of remote controlled or electronic door locks on automobile doors has been a popular success with consumers.

The present subject matter is directed to a device that provides for separate manual or powered control of the lock, thereby allowing manual actuation of the lock independently of the powered actuation. One application of such an arrangement may be used on the plurality of storage compartments often found on variety of vehicles such as service trucks, delivery vans, and pick-up truck. For security reasons, each of these compartments typically has a key operated lock and is often equipped with a lock commonly referred to as a "paddle handle" lock. Each of these locks must be locked one at a time by manipulating the lock cylinder with a key. The result is a time consuming task for the user to move about the vehicle and lock and unlock each compartment. The tedious and time consuming nature of the task gives rise to the risk of the user deciding to forego locking one of the compartments, thus compromising security of the compartment. The installation of a device that enables the user to manipulate the locking device remotely enhances productivity of the user and security of the compartment.

One example of a manual and powered locking device may be found in U.S. Pat. No. 8,146,394, the disclosure of which is incorporated by reference herein. As is typical of existing manual and powered locking devices, the device employs a cylinder lock having a plug or core to manually rotate the cam and a powered actuator to rotate the cam to a certain position to lock or unlock the door. However, a problem with cylinder locks is that when the lock plug has been manually turned to a locked position the key can be removed from the lock plug, leaving the lock plug fixed to the lock body. Subsequently, the powered actuator cannot rotate the cam. Ultimately, the user is unable to use the powered actuator to unlock the lock; the user is left to manipulate the lock only manually. As a result, the convenience factor of a powered locking device is eliminated. Both the U.S. Pat. No. 8,146,394 and the present disclosure overcome this problem.

Other deficiencies of the existing market solutions center around the fact that the existing solutions in the market use linear actuators, rods, cams and linkages to adapt an existing key-only locking handle to add an electric or powered function. However, existing locking handles in the market have already been designed to change state based on an approximately 90° rotation of a member, this member is driven by the key. The existing practice though usually uses a linear actuator which then must have its motion converted, via rods, cams, links, levers and the like, to a rotary motion that is suitable for that particular handle. Furthermore, in doing so one has to provide the means to allow either/or state change (key or electric). U.S. Pat. No. 5,493,881 does show an example of how this is done with a mechanism that is often called "lazy action".

There is therefore a need for a manual and powered actuation of a locking device that allows the user to lock and unlock the device with the key or the powered device regardless of the position of the lock plug.

SUMMARY

The present invention concerns an actuator assembly for manual or powered actuation of a handle and lock mechanism of the type having a lock structure and a locking member such as locking link. The actuator assembly includes a housing for mounting a motor and a powered drive train engaged with the motor. An actuating member is connectable to the locking link and is movable between a first and a second position. The actuator assembly includes a manual drive member with first and second drive surfaces spaced apart from one another. The lock structure is connectable to the manual drive member to allow forward and reverse motion from a neutral position. In addition, the actuator assembly includes a powered drive member with first and second drive surfaces spaced apart from one another. The powered drive train is connectable to the powered drive member to allow forward and reverse motion from a neutral position.

The actuating member is disposed intermediate the spaces between the first and second drive surfaces of each drive member. Rotation of the first drive surface of each drive member causes rotation of the actuating member from its first position to its second position upon movement of one of the drive members from its neutral position to its forward position. Similarly, the actuating member is engageable by the second drive surface of each drive member for moving the actuating member from its second position to its first position upon movement one of the drive members from the neutral position to the reverse position.

The present invention duplicates the (typically 90°) motion that the handle and lock mechanism is already designed to use. Also, the invention provides a very simple way to accept the motion of the existing lock structure. In a non-electric handle, the key rotates a lock plug, typically 90°, one way is locked, the other way is unlocked. The present invention provides a novel and compact way to provide that same motion, only through the present mechanism that motion can be accomplished by using either a key or electric means. It uses fewer parts than other mechanisms accomplishing this. This disclosure allows the wide variety of different locking handles and designs in the market to be most easily converted to dual key/electric operation, and with minimum redesign and retooling. This has significant value to both manufacturers of handles, who have a very wide existing product line that currently works with key locking only, and to owners and operators of products that employ these handles. Only slight revisions of the parts and features described here will need to be developed to make it very easy for these entities to convert their key-only locking handles to combination electric and key. All this is achieved in a highly compact structure. The present disclosure incorporates the following improvements and innovations:

Improved alignment means are provided for easier alignment to the latch mechanism and key lock. In the present device where we have two rotating means of accomplishing an action (rotating a key in the key lock cylinder, and/or powering an electric motor), these two rotating means need to be aligned to be coaxial. The present design locates and installs directly to the rotatable plug of the key lock cylinder, thereby ensure co-axial alignment without the need to maintain a string of tolerances. Mounting this way also provide greater flexibility in mounting the actuator to multiple handle latch mechanisms presently on the market that do not presently have power locking means. The rotatable plug or core of the key lock cylinder is functionally extended through the housing of the actuator, coaxial with the rotating output member of the rotary actuator, so that the actuator is radially and axially retained relative to the rotatable plug or core of the key lock cylinder. In the embodiment shown, a commercially available key lock cylinder is used that has a female thread on the rotatable plug or core of the key lock cylinder. This feature is present in the market to allow users of these key lock cylinders to attach elements to the key lock cylinder's rotatable core via a common screw. For the present embodiment a hex head cap screw is used that has also has a female thread which is used to attach the actuator to the rotatable plug or core in a construction that uses fewer parts.

The key locking means are separated from the powered rotary actuator locking means. This allows a handle latch assembly to be produced that is common to both a "key-only" and a "key-plus-electric" version offered to the market. This allows a customer to retrofit a key-only latch with the electric rotary actuary.

A torsion return spring has a pair of fingers which extend outwardly from the coils rather than inwardly as in the U.S. Pat. No. 8,146,394 design. The concept is still the same in which there are three C-shaped features: one fixed, non-rotatable housing feature, one rotatable C-shaped feature for the member that rotates when the lock key is rotated, and one rotatable C-shaped feature that rotates when the electric motor is operated.

A recurring problem is that sometimes users of the manual key portion of the device do not realize when an opening or closing movement has been fully achieved. As a result the user continues to apply torque to the key after the actuator parts have already obtained their new limit positions. This has the potential to damage the actuator parts. With the different torsion return spring finger configuration and a drive wedge that spans at least both the manual and motor-driven drive surfaces, the present disclosure is able to prevent any over-rotation, and also to prevent damage to the return spring legs caused by over torqueing of the manual key lock.

The present disclosure uses the torsion of the return spring to create a snap fit against other members to provide for axial retention of a couple of the parts, which is useful during assembly and handling of the actuator before it is attached to the handle latch assembly.

Actuators according to the present disclosure are particularly well-suited for manual or powered locking and unlocking of a lock. Of course, it will be appreciated that the actuators described herein are not limited to particular locking devices, but may find use in many different applications requiring selected movement of an actuating member.

DETAILED DESCRIPTION

Figure 42:
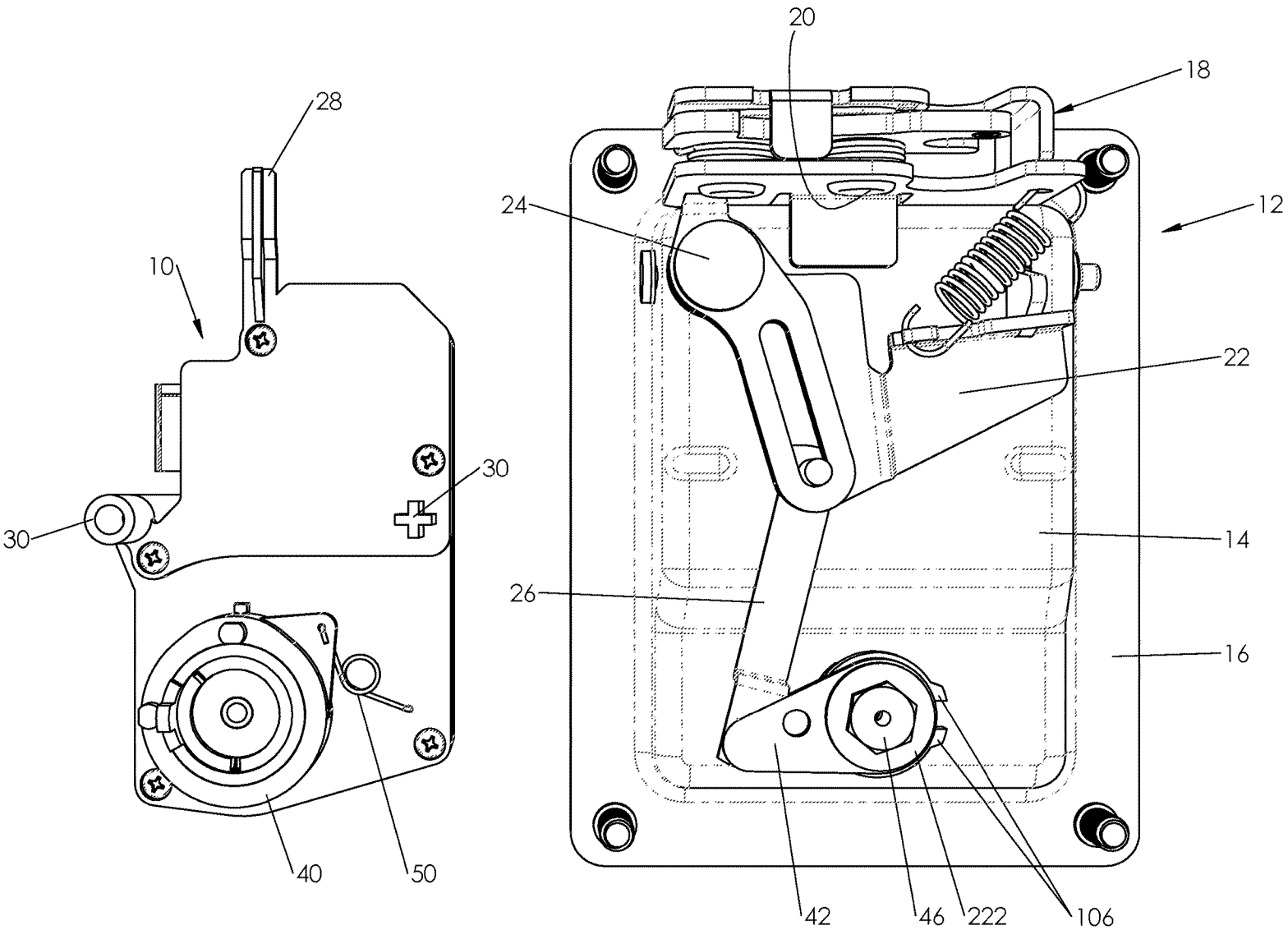
FIG. 42 is a front elevation view of the actuator about to be installed on one form of handle and lock mechanism, with the interior of the handle and lock mechanism being shown in this view.

A general overview of the environment in which the rotary lock actuator 10 of the present disclosure operates is shown in FIG. 42. The rotary lock actuator 10 here is mountable on a handle and lock mechanism which is shown generally at 12. It will be understood that the handle and lock mechanism is incorporated in another structure (not shown), such as a vehicle door or a storage box door. One of the advantages of the rotary lock actuator assembly 10 is that it can be incorporated in existing doors without requiring modification of the door and little or no modification of the handle and lock mechanism. Thus, much of the handle and lock mechanism 12 is conventional. A typical example is shown in U.S. Pat. No. 6,513,353, the disclosure of which is incorporated herein by reference.

The handle and lock mechanism 12 includes a pan or tray 14 including a decorative escutcheon 16 around the perimeter of the pan. At the top of the pan 14 is a rotary latch assembly 18 which includes a hollow bushing 20 therein. The rotary latch assembly 18 also defines a cutout or notch. When the door (not shown) to which the handle and lock mechanism 12 is attached is closed the cutout receives therein a striker bolt (not shown) which is fastened to the vehicle's door frame or the fixed portion of a storage box or the like. Once the door is closed and the striker bolt is in the cutout, the latch rotates to engage the striker bolt. Engagement of the latch with the striker bolt prevents opening of the door to which the handle and lock assembly is attached. To open the door, a user lifts a handle (not shown), pivoting it about hinge pin and lifting a lever. The lever is connected to the latch such that lifting of the lever causes rotation of the latch. This in turn removes the cutout from engagement with the striker bolt, thereby freeing the door to open.

Underneath the rotary latch assembly 18 is an operating linkage 22 which is pivotable about headed shoulder pin 24. Linkage 22 in turn is actuated by a locking link 26. It will be understood that the pan 14 also mounts a lock cylinder thereon. While the lock cylinder is not visible in FIG. 42, it is located on the longitudinal centerline of the pan 14, near the bottom edge thereof. All of the foregoing description of the handle and lock mechanism is conventional and details are described in the U.S. Pat. No. 6,513,353.

The rotary lock actuator assembly 10 of the present disclosure is mountable on the lock mechanism 12 by turning the actuator assembly 10 over from the view shown in FIG. 42 and placing a machine screw (not shown here but will be described below) through an opening in the actuator assembly 10 and threading it to an extension of the lock cylinder plug. A stay 28 extending from the top of the actuator assembly 10 fits into the bushing 20 of the rotary latch assembly 18 to prevent rotation of the actuator assembly. A pair of spacers 30 extend from the housing of the actuator assembly 10 to further stabilize the actuator assembly on the pan 14.

The handle and lock mechanism, of course, also includes means for selectably preventing the release of the latch from the striker bolt. This includes the aforementioned lock cylinder mounted in the pan 14. The lock structure can be actuated manually from the front of the device by a user inserting a key in the lock structure and turning it. The lock structure can also be actuated by a motor in the actuator assembly 10. Whether actuation is effected manually or electrically, it results in translation of the locking link 26 and the operating linkage 22.

It should be appreciated that the actuator assembly 10 may be used with a wide variety of lock structures or locking linkages. The actuator assembly is constructed as shown in order to be retrofit to an existing lock. Alternately, the actuator assembly may be constructed in accordance with the needs of a specific handle design.

Figure 1A:
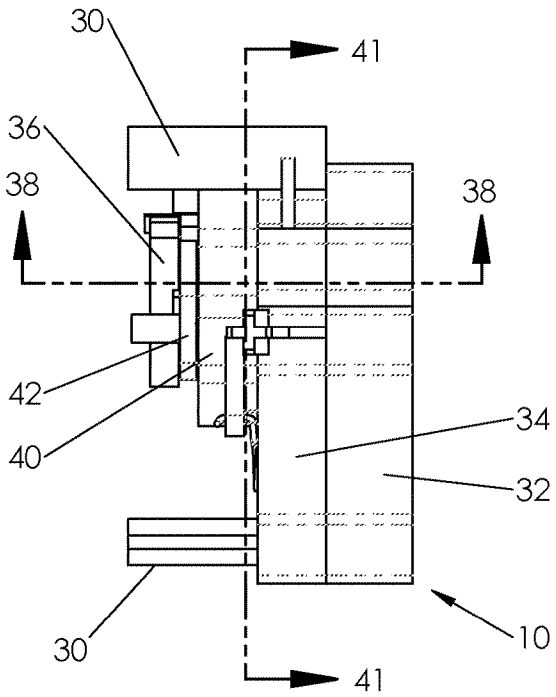
FIG. 1A is a top plan view of the actuator assembly of FIG. 1.
Figure 1:
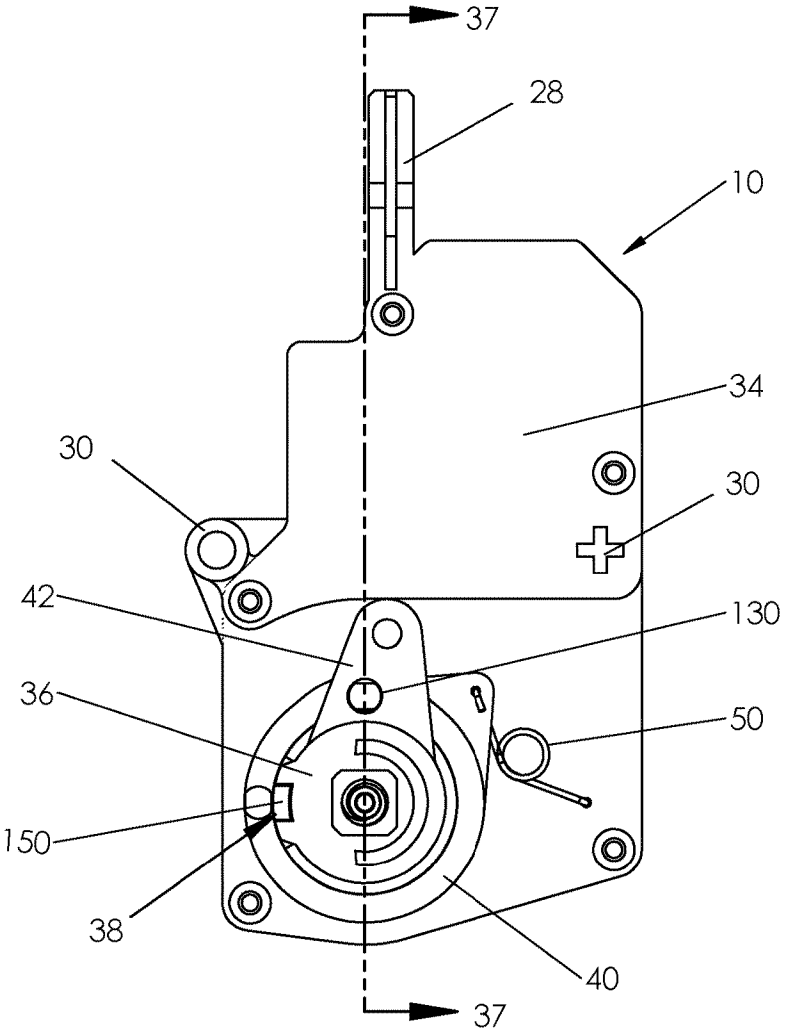
FIG. 1 is a front elevation view of the rotary lock actuator assembly of the present disclosure.
Figure 3:
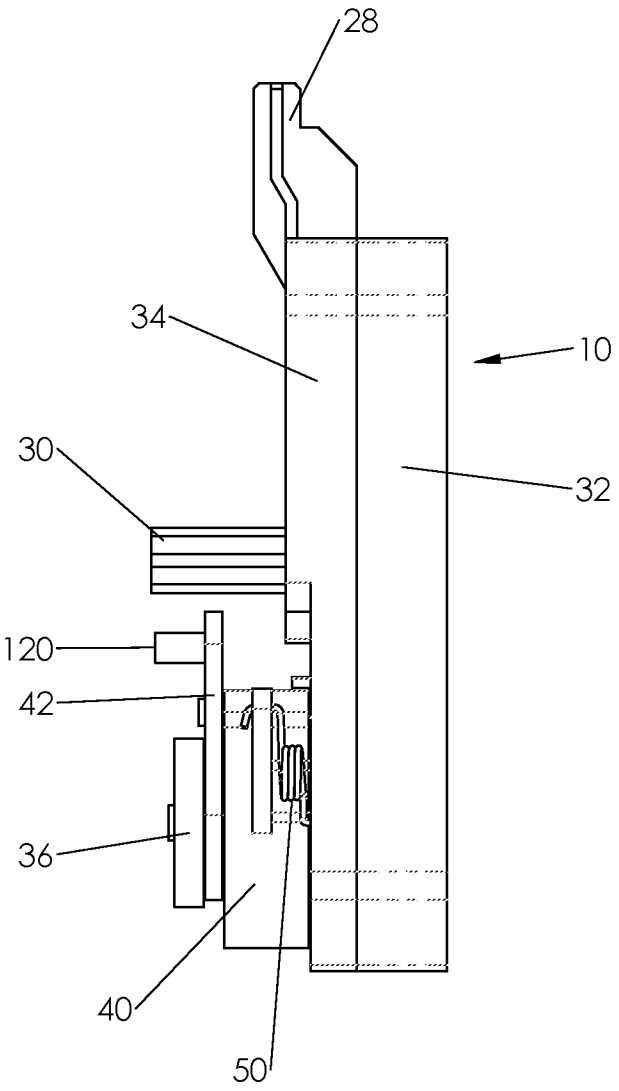
FIG. 3 is a right side elevation view of the actuator assembly of FIG. 1.
Figure 2:
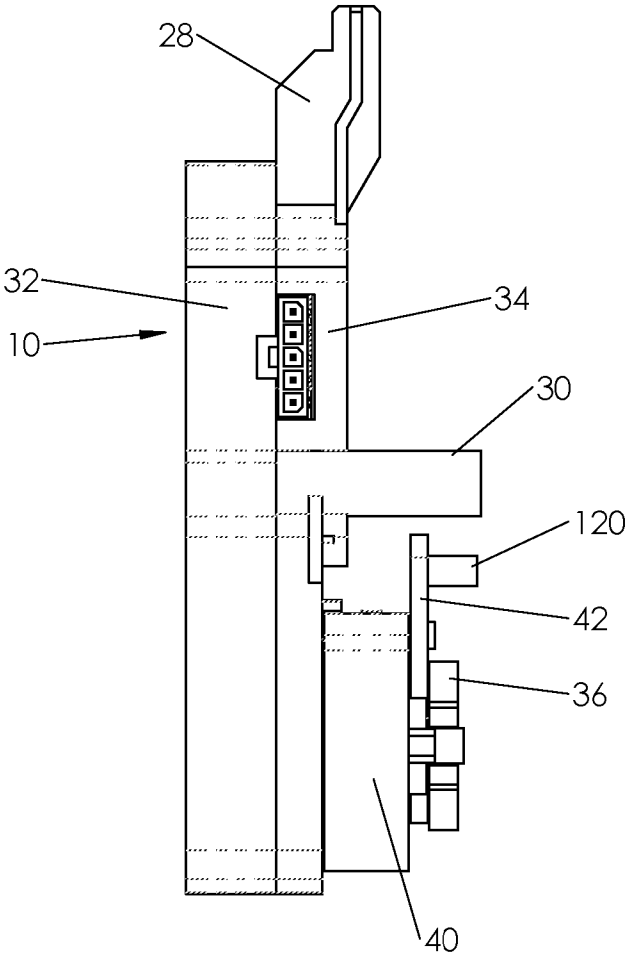
FIG. 2 is a left side elevation view of the actuator assembly of FIG. 1.

The overall structure of the actuator assembly 10 is shown in FIGS. 1-3. The assembly includes a two-part housing including a base 32 and a cover 34. Details of the two housing parts will be described below. Parts exterior to the housing include a lock cylinder adaptor 36. For ease of reference the abbreviation "LC" will be used herein for lock cylinder. The LC adaptor 36 is rotationally fixed to an LC input, portions of which are visible at 38 in FIG. 1. Surrounding the LC input 38 is a latch output 40. The latch output 40 is mounted for rotation on the LC input 38. Located underneath the LC adaptor 36 and mounted for rotation thereon is an output cam 42. The latch output 40 is rotationally fixed to the output cam 42. Thus, the latch output 40 and the cam 42 rotate together. The externally visible parts are held together by a machine screw 44 that threads into a cap screw 46. The remaining parts visible on the exterior are a switch actuator 48 and a bi-stable spring 50.

Figure 4:
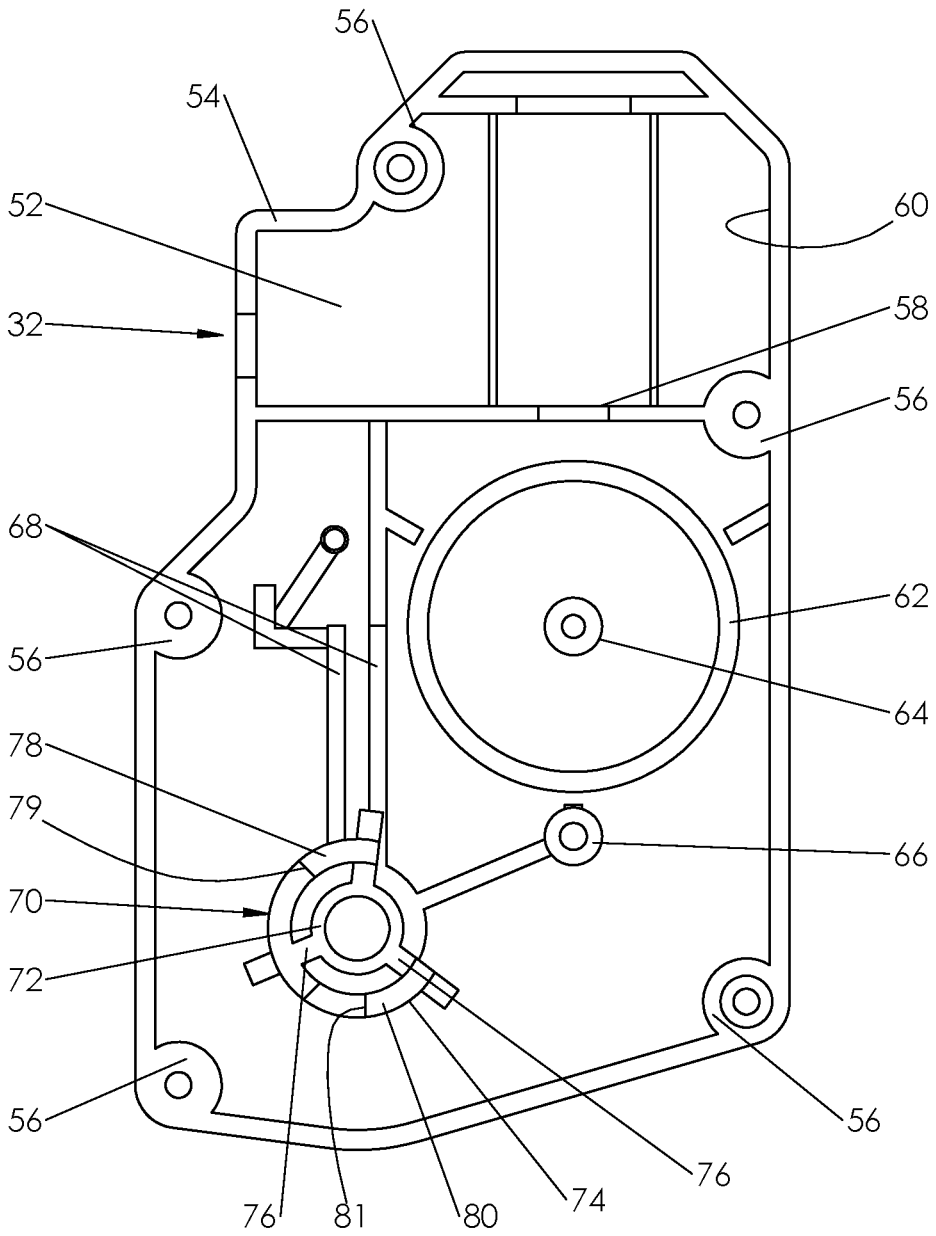
FIG. 4 is a front elevation view of the housing base.
Figure 6:
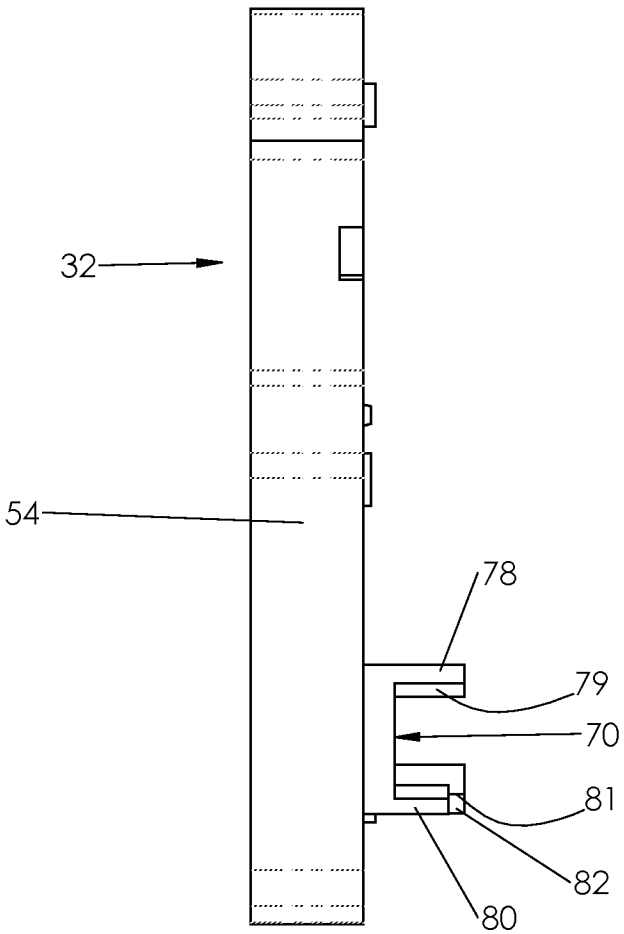
FIG. 6 is a left side elevation view of the housing base.
Figure 5:
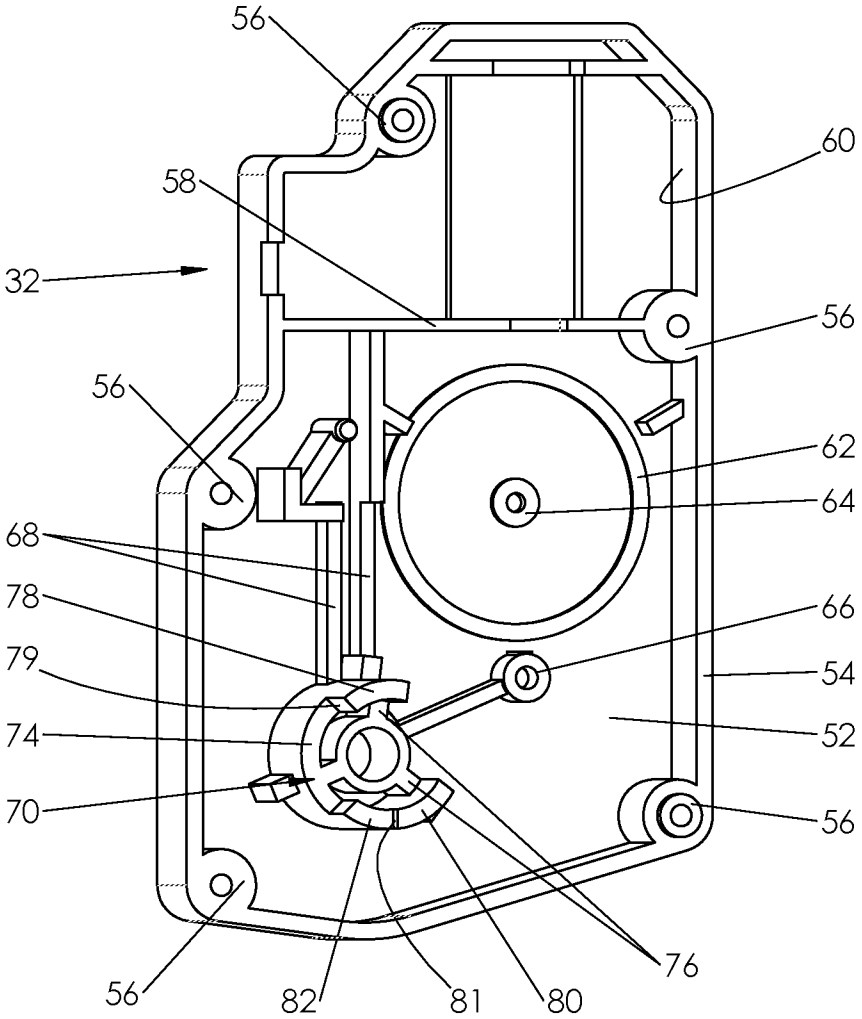
FIG. 5 is a perspective view of the interior of the housing base.

FIGS. 4-6 illustrate details of the housing base 32. The base has a floor 52 with an upstanding wall 54 around its perimeter. Bosses 56 are formed in the corners of the wall 54 with bores therein for receiving fastening screws (not shown) holding housing parts together. The floor has an internal wall 58 which defines a motor compartment 60. Below the wall 58 is an upraised gear pad 62 with a shaft socket 64 formed therein. Another shaft socket 66 is located below the gear pad 62. A pair of spaced, vertical rails 68 extend to the left of the gear pad. They terminate at a mandrel 70.

The mandrel is a somewhat complex structure having an arcuate outer sleeve 74 and a cylindrical inner sleeve 72 joined to the outer sleeve by webs 76. There is a counterbore 77 (FIG. 37) formed in the floor 52 under the inner sleeve 72. Two spring retainer walls extend axially from the top of the outer sleeve. The first spring retainer wall 78 has an axial end face 79. The second spring retainer wall 80 has an axial end face 81 defined by a notch 82 on its outer end.

Figure 7:
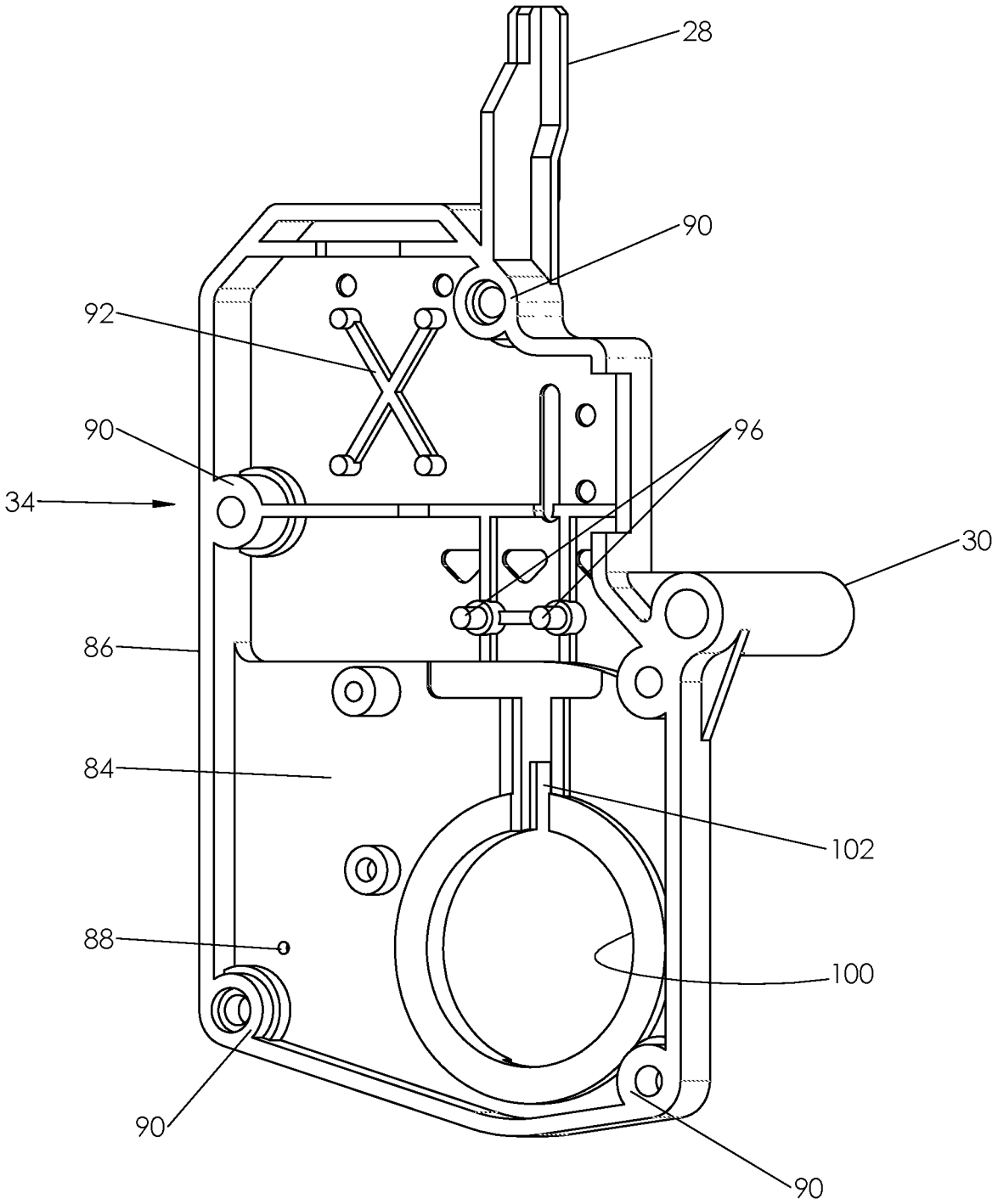
FIG. 7 is a perspective view of the housing cover, looking at the interior of the cover.
Figure 8:
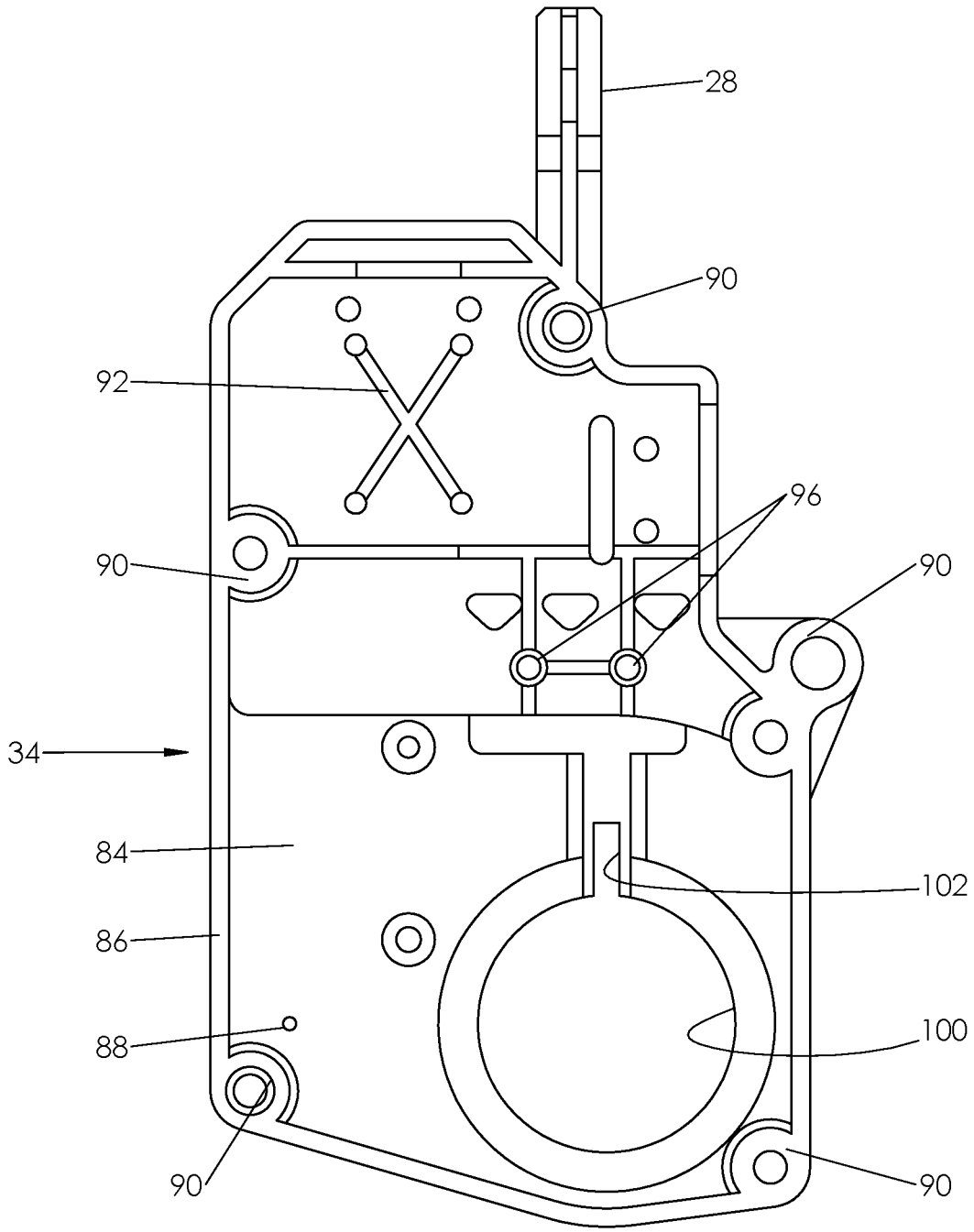
FIG. 8 is a rear elevation view of the housing cover, i.e., looking at the interior of the cover.
Figure 9:
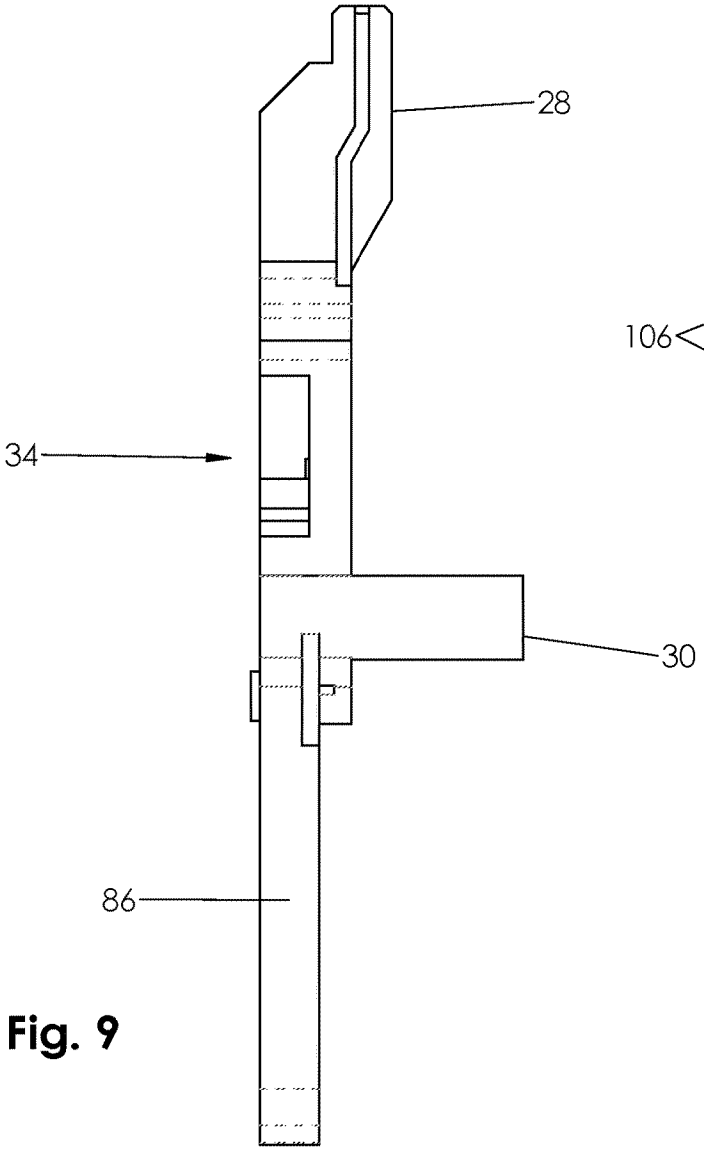
FIG. 9 is a left side elevation view of the housing cover.
Figure 37:
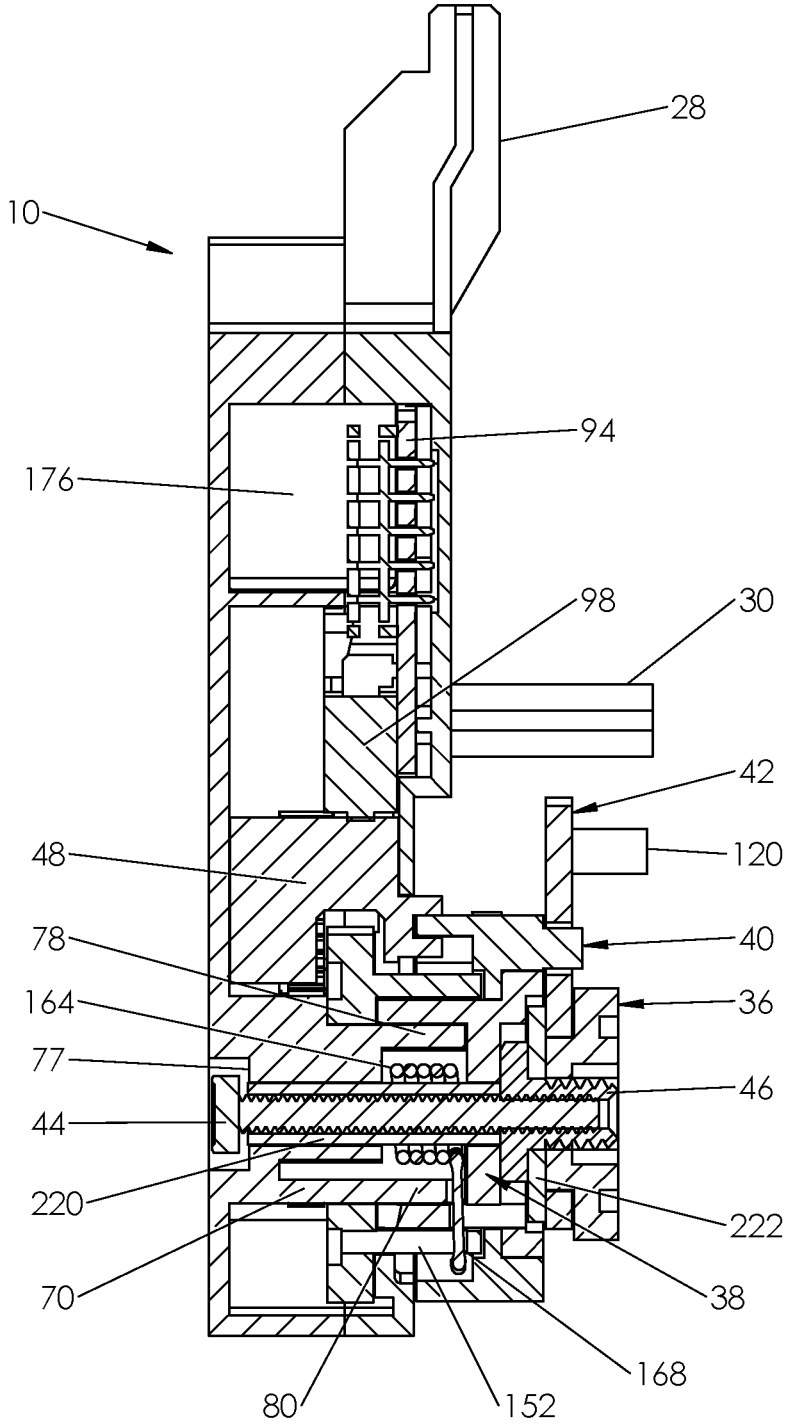
FIG. 37 is a section taken along line 37-37 of FIG. 1.
Figure 39:
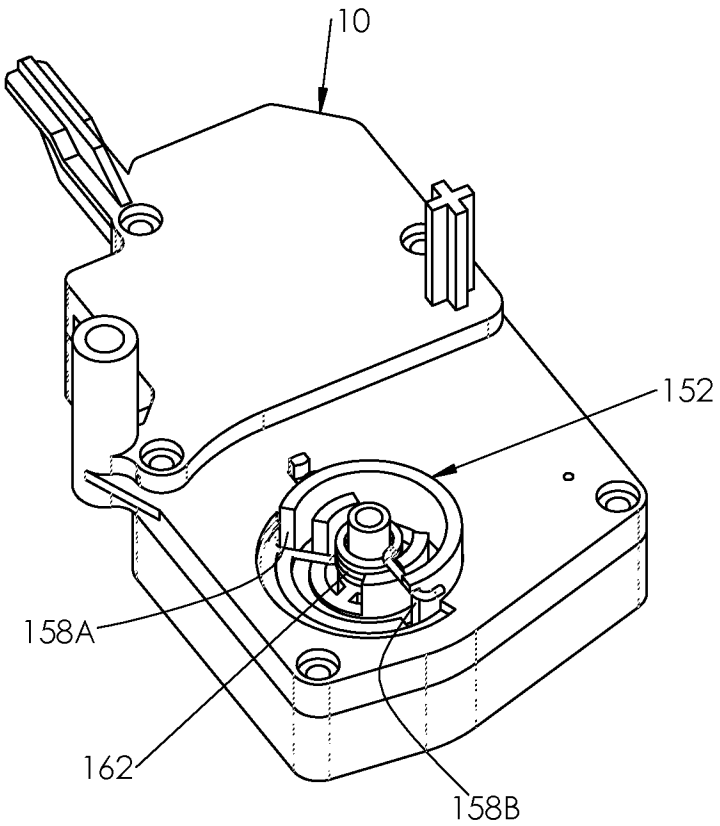
FIG. 39 is a perspective view looking at the front of the actuator with the parts external to the output gear removed to illustrate the output gear and the bushing in the housing base.
Figure 38:
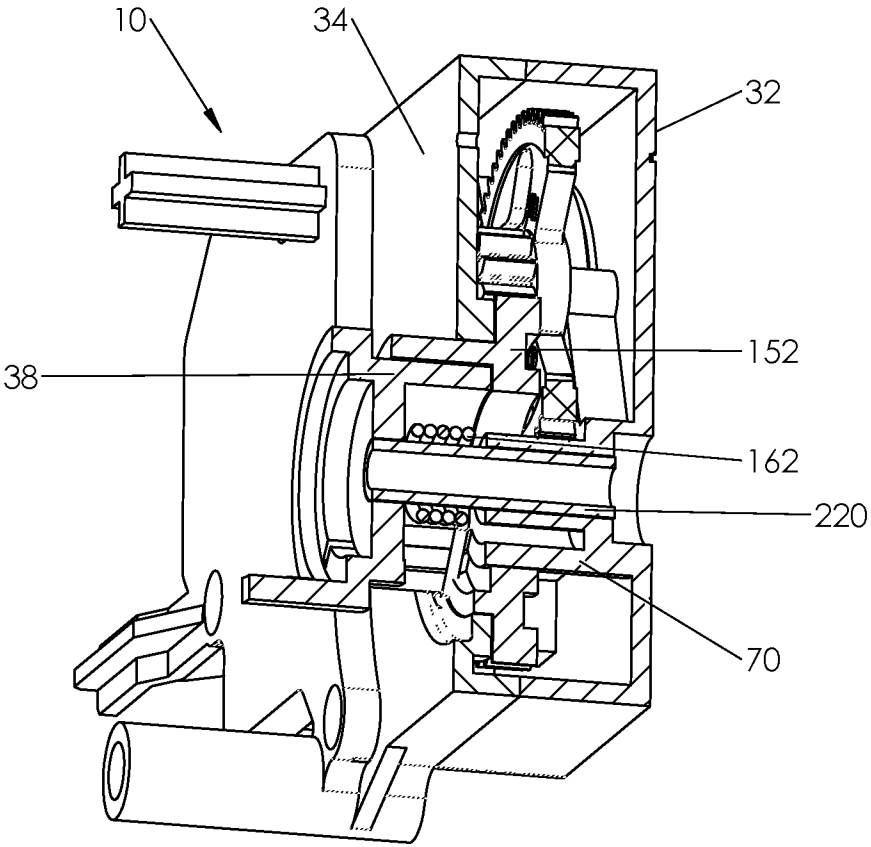
FIG. 38 is a section taken along line 38-38 of FIG. 1A.

FIGS. 7-9 illustrate details of the housing cover 34. The cover fits adjacent to the base 32. The cover has a plate 84 with an upstanding wall 86 around its perimeter. The stay 28 and the spacers 30 extend from the wall 86. In one corner of the plate 84 there is a small hole 88 for receiving one leg of the bi-stable spring 50 as will be explained below. Apertures 90 in the corners of the wall 86 align with the bores in the bosses 56 to allow passage of the fastening screws. An X-shaped support 92 accommodates a printed circuit board 94 (FIG. 37) mounted in the housing. Pegs 96 support an electrical switch 98 (FIG. 37). A circular opening 100 extends through the plate 84 to accommodate the mandrel 70 and surrounding movable parts. The opening 100 merges with a vertical slot 102 that accommodates the switch actuator 48.

Figure 10:
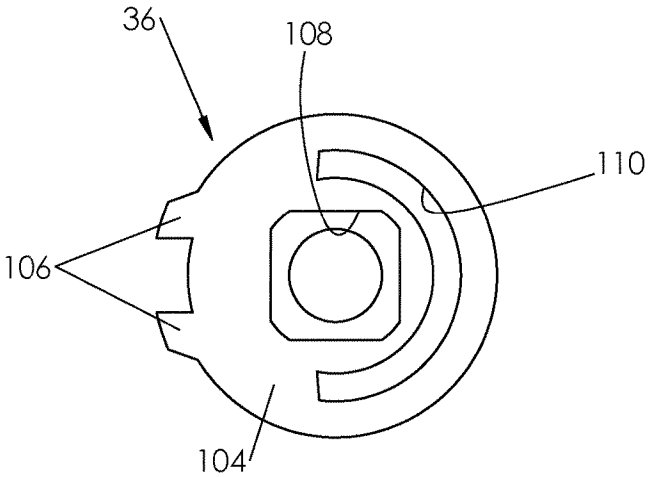
FIG. 10 is a front elevation view of the locking cylinder adaptor.
Figure 11:
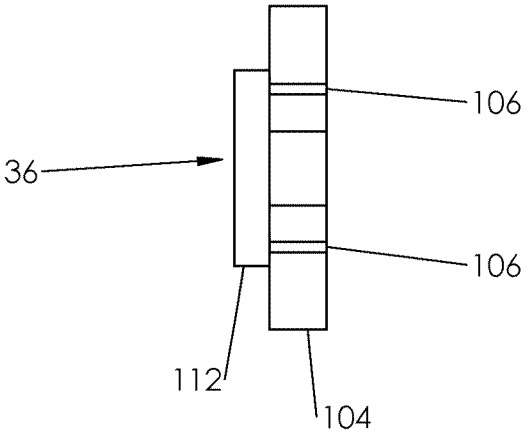
FIG. 11 is a left side elevation view of the locking cylinder adaptor.

FIGS. 10 and 11 show the LC adaptor 36. The LC adaptor has a disc 104 that is generally cylindrical except for two radially extending ears 106. The ears define a slot between them that receives a catch on the LC input 38, thereby rotationally locking the LC adaptor to the LC input. The disc 104 also has an octagonal depression 108 in the middle of the disc. This depression receives a square end of the lock cylinder's plug, thereby rotationally locking the plug to the LC adaptor. A C-shaped groove 110 surrounds the depression 108. The groove 110 limits the rotation of the LC adaptor 36 (and the components fixed thereto) by virtue of a fixed tang (not shown) on the end of the lock cylinder body that fits into the groove 110. On the rear side of the disc 104 there is a boss 112. The output cam 42 is mounted for rotation on the boss 112.

Figure 13:
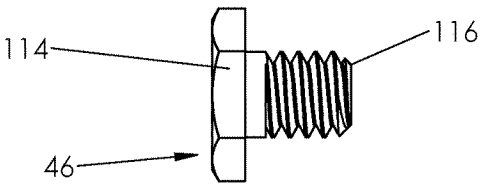
FIG. 13 is a left side elevation view of the hex head cap screw.
Figure 12:
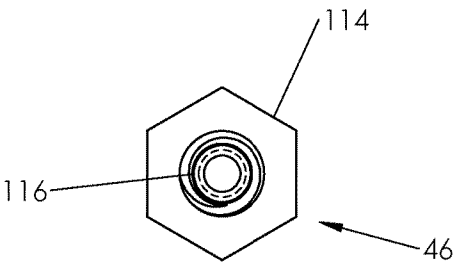
FIG. 12 is a front elevation view of the hex head cap screw.

FIGS. 12 and 13 illustrate the cap screw 46. It has a hex head 114 and a hollow shank 116. The shank is both internally and externally threaded. The external threads engage the internal threads of the plug of a lock cylinder (not shown here but see FIG. 40) on the lock mechanism 12. The internal threads are engaged by the machine screw 44.

Figure 15:
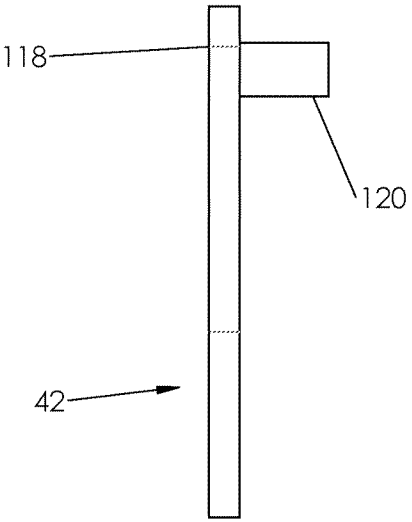
FIG. 15 is a left side elevation view of the output cam.
Figure 14:
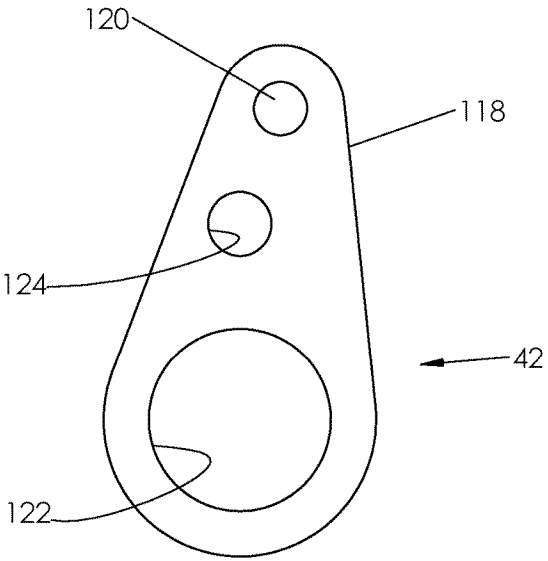
FIG. 14 is a front elevation view of the output cam.
Figure 17:
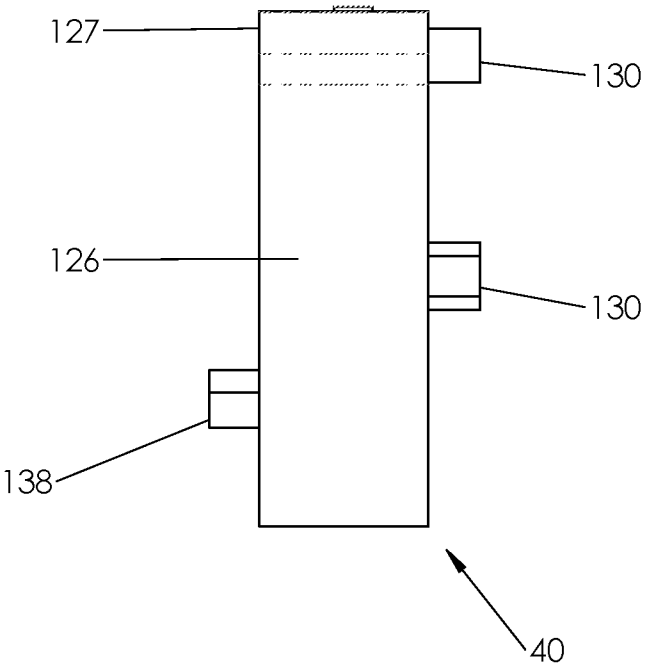
FIG. 17 is a left side elevation view of the output for latch.
Figure 16:
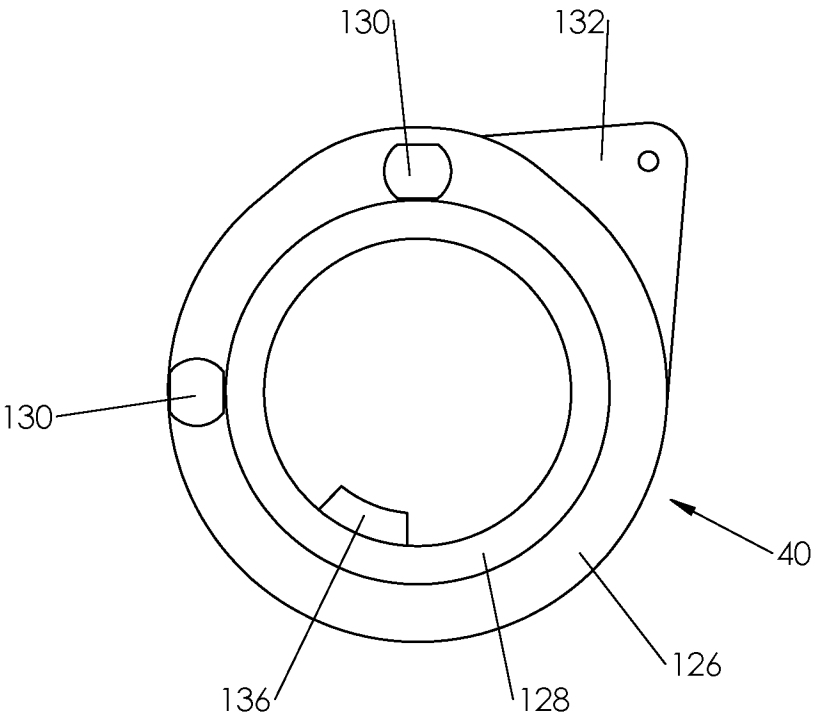
FIG. 16 is a front elevation view of the output for latch.
Figure 19:
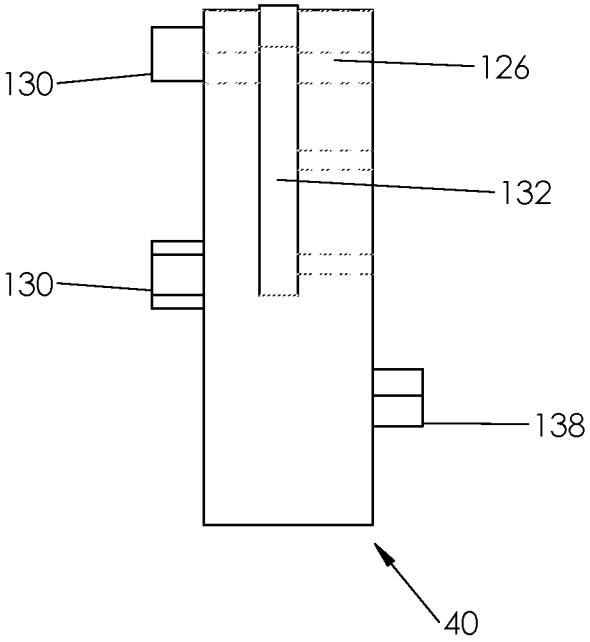
FIG. 19 is a right side elevation view of the output for latch.
Figure 18:
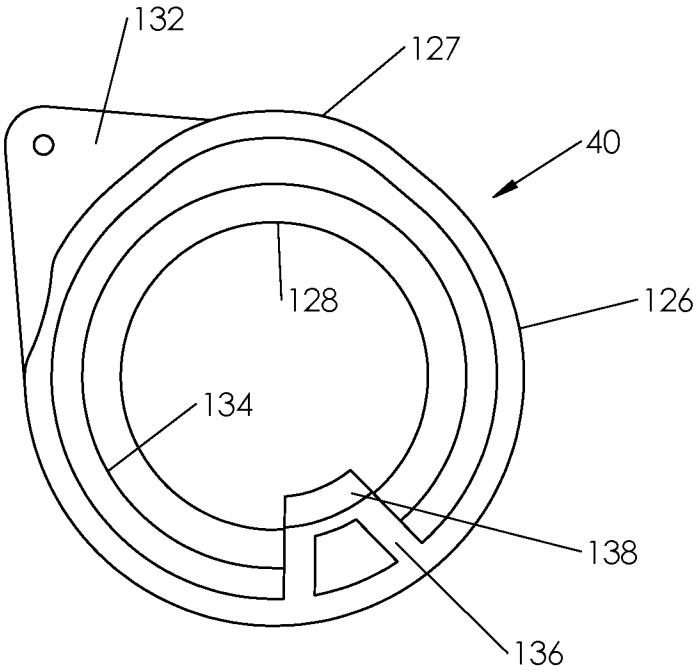
FIG. 18 is a rear elevation view of the output for latch.
Figure 21:
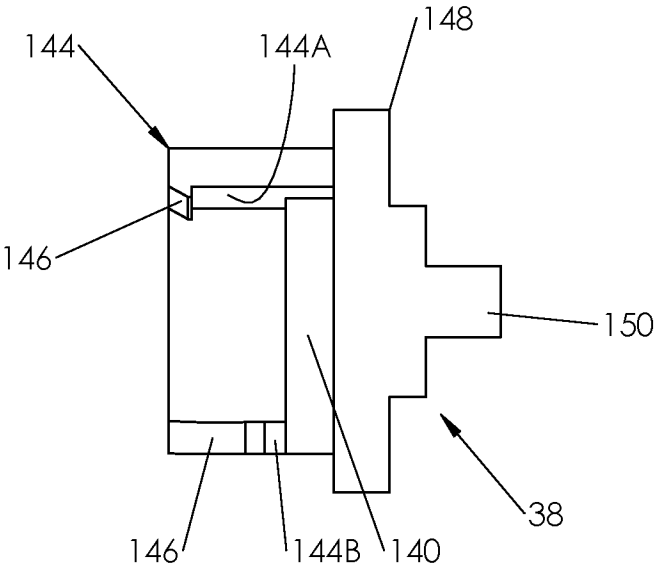
FIG. 21 is a left side elevation view of the lock cylinder input.
Figure 20:
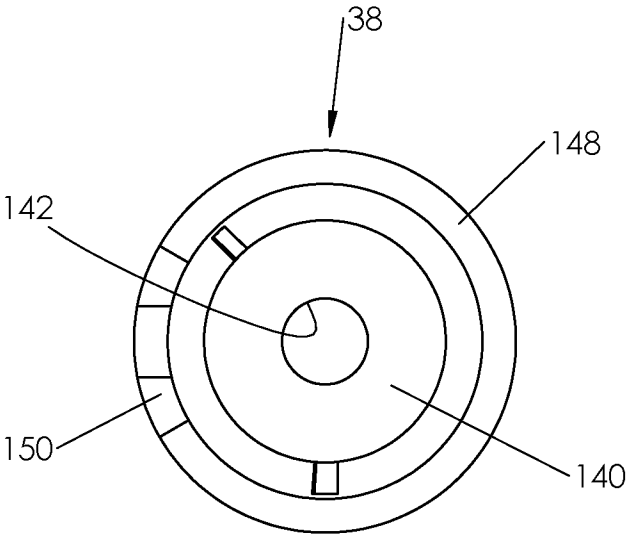
FIG. 20 is a front elevation view of the lock cylinder input.
Figure 23:
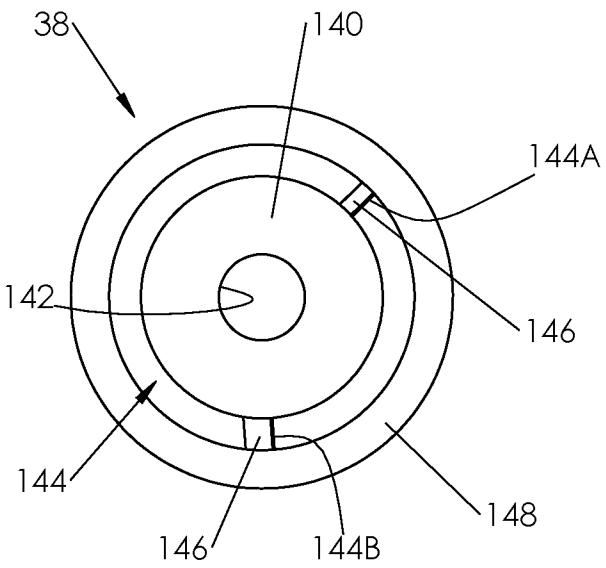
FIG. 23 is a rear elevation view of the lock cylinder input.
Figure 22:
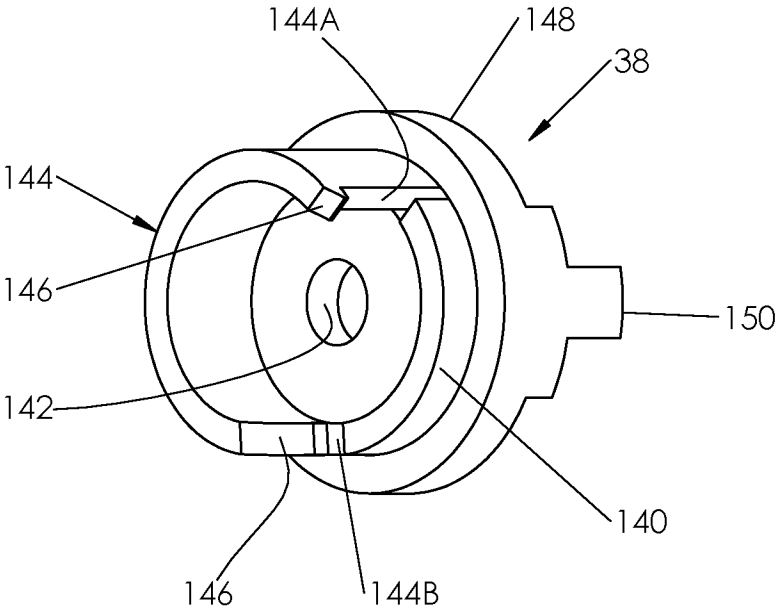
FIG. 22 is a perspective view of the left side of the lock cylinder input.
Figure 25:
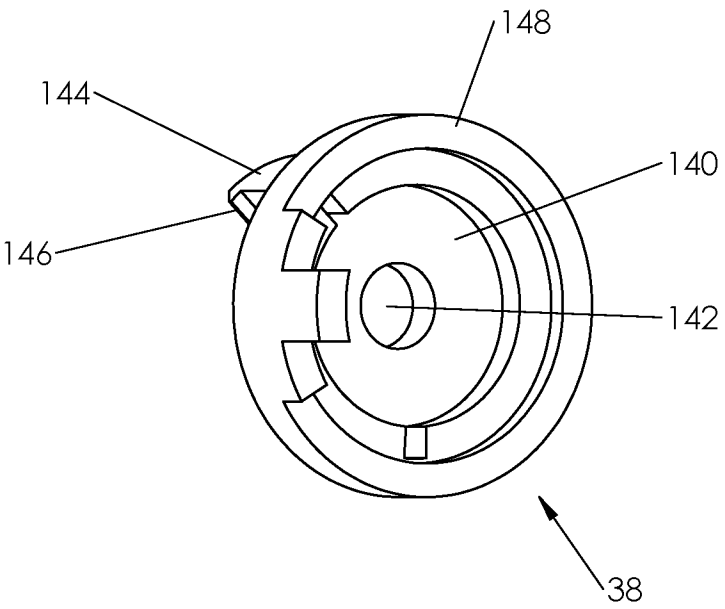
FIG. 25 is a perspective view of the right side of the lock cylinder input.
Figure 24:
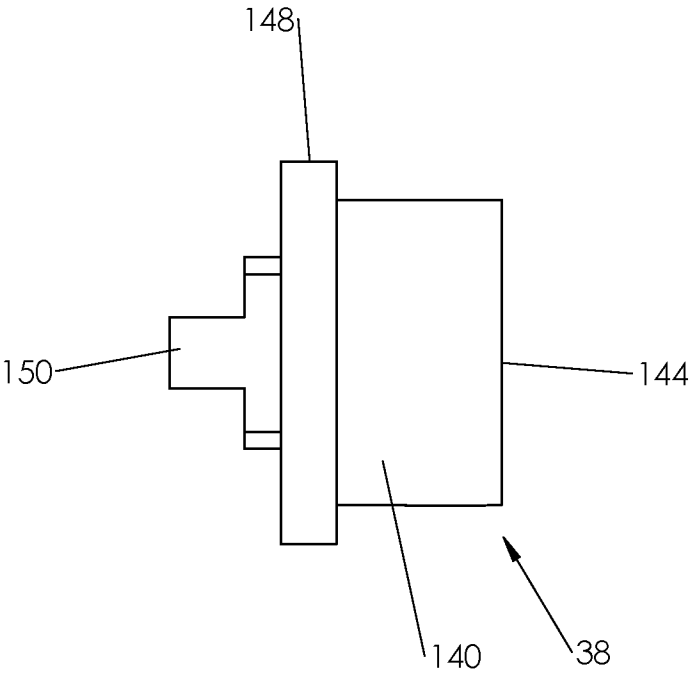
FIG. 24 is a right side elevation view of the lock cylinder input.
Figure 27:
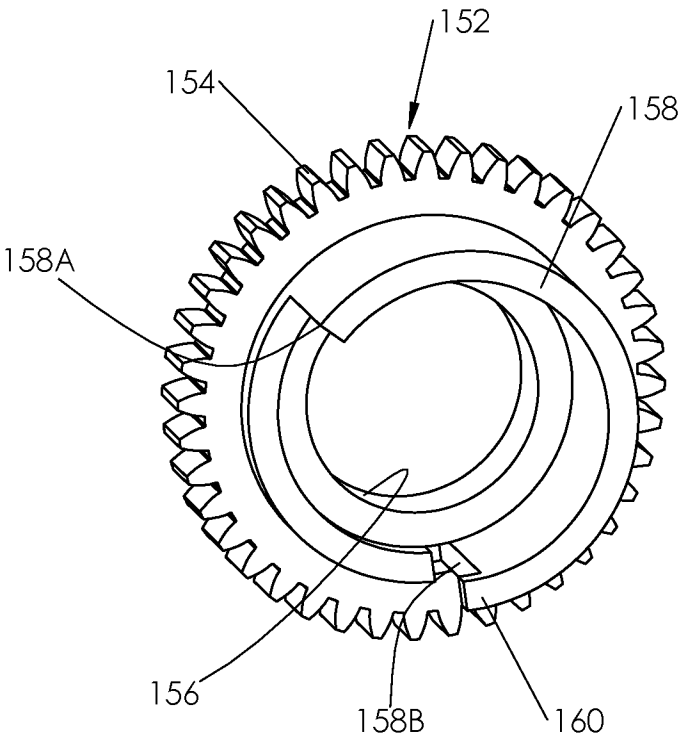
FIG. 27 is a front perspective view of the output gear.
Figure 26:
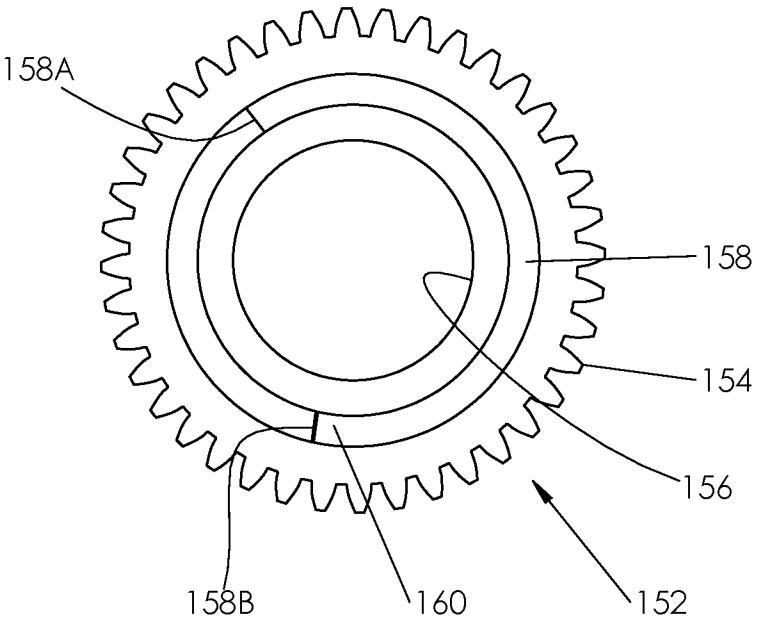
FIG. 26 is a front elevation view of the output gear.
Figure 29:
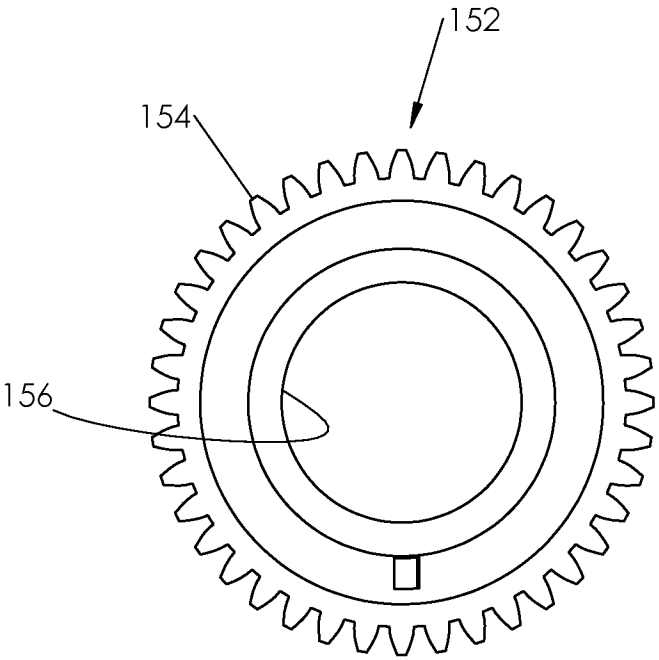
FIG. 29 is a rear elevation view of the output gear.
Figure 28:
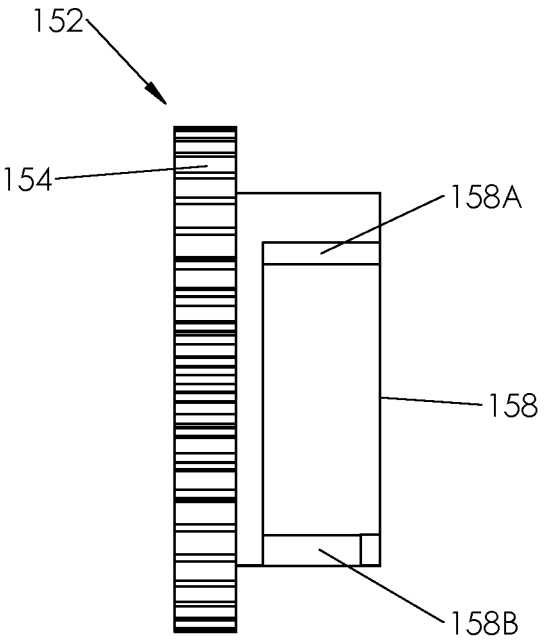
FIG. 28 is a left side elevation view of the output gear.
Figure 30:
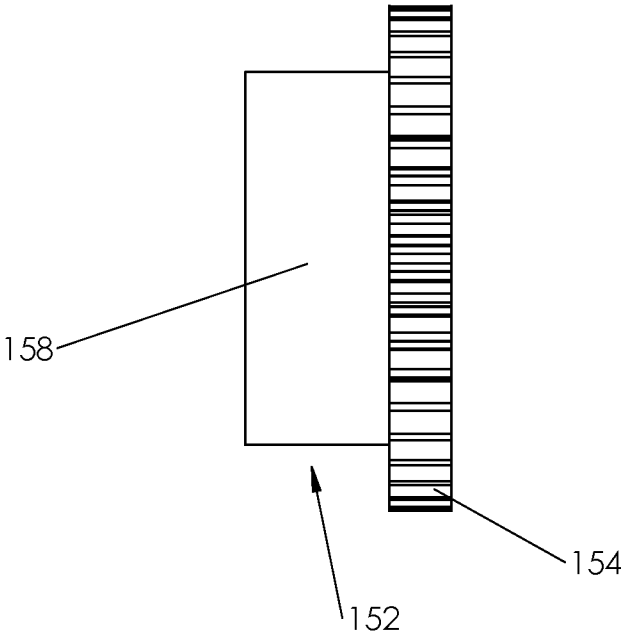
FIG. 30 is a right side elevation view of the output gear.

FIGS. 14 and 15 illustrate the output cam 42. The cam has a plate with a lobe 118 at one end and a pin 120 extending from the front side of the lobe. The pin is engageable with the locking link 26 of the lock mechanism 12, as best seen in FIG. 42. The end of the plate opposite the lobe 118 has a large opening 122. The opening 122 fits over the boss 112 on the rear side of the LC adaptor 36. Intermediate the two ends of the plate there is an aperture 124. This aperture receives a drive stud 130 of the latch output 40.

FIGS. 16-19 illustrate the latch output 40. It is basically a cylindrical ring 126 with an internal flange 128. The rear edge of the ring 126 defines a cam surface 127. The front surface of the ring has a pair of drive studs 130. Only one of the drive studs at a time is used but provision of two drive studs makes the part usable with different output cams, thereby affording greater flexibility for adapting to different lock mechanisms 12. A radially-extending bracket 132 has a hole therein for receiving one of the legs of the bi-stable spring 50. The rear side of the flange 128 has an undercut 134. A drive wedge 136 is formed on the internal surface of the ring adjacent the undercut 134. The drive wedge 136 has an extension 138 which is engageable with one of the legs of a torsion return spring as will be explained below.

FIGS. 20-25 illustrate the lock cylinder input 38. This is a relatively complex structure made of three primary sections. First, there is a disc-shaped central hub 140 having a bore 142 through it. Second, extending axially rearwardly from the hub 140 is a C-shaped wall 144 whose edges define first and second drive surfaces 144A, 144B. Hooks 146 are formed on the drive surfaces to assist in retaining the legs of the torsion return spring. The hooks 146 also have a beveled upper surface. This is useful during assembly of the actuator in that the return spring 162 can be installed on the output tube 222 and subsequently the lock cylinder input 38 can be pushed into place. The beveled upper surfaces of the hooks 146 allow the spring legs 166, 168 to flex up and over the C-shaped wall 144, ending up with the spring legs 166, 168 engaged with the first and second drive surfaces 144A, 1448, respectively. The internal diameter of the C-shaped wall 144 is slightly greater than the outside diameter of the first and second spring retainer walls 78, 80 of the mandrel 70, thereby permitting the mandrel to fit inside the LC input in telescoping relation. The third section of the LC input, extending axially forwardly from the hub 140 is an annular ring 148. The forward edge of the ring has a stepped extension terminating at a catch 150. This is the catch that engages the ears 106 of the LC adaptor 36 to rotationally lock the LC adaptor 36 and LC input 38 together.

FIGS. 26-30 illustrate a portion of the drive train, namely, an output gear 152. The output gear includes a spur gear 154 with external teeth thereon. There is a large opening 156 through the center of the spur gear. The opening is sized to permit the output gear to rotate on the outer sleeve 74 of the mandrel 70. On the front of the spur gear is an axially-extending C-shaped wall 158. The edges of wall 158 define first and second drive surfaces 158A, 158B. A hook 160 is formed on one of the drive surfaces to assist in retaining the legs of the torsion return spring. The internal diameter of the C-shaped wall 158 is slightly greater than the outside diameter of the LC input's C-shaped wall 144, thereby permitting the LC input's C-shaped wall 144 to fit inside the C-shaped wall 158 of the output gear in telescoping relation.

Figure 32:
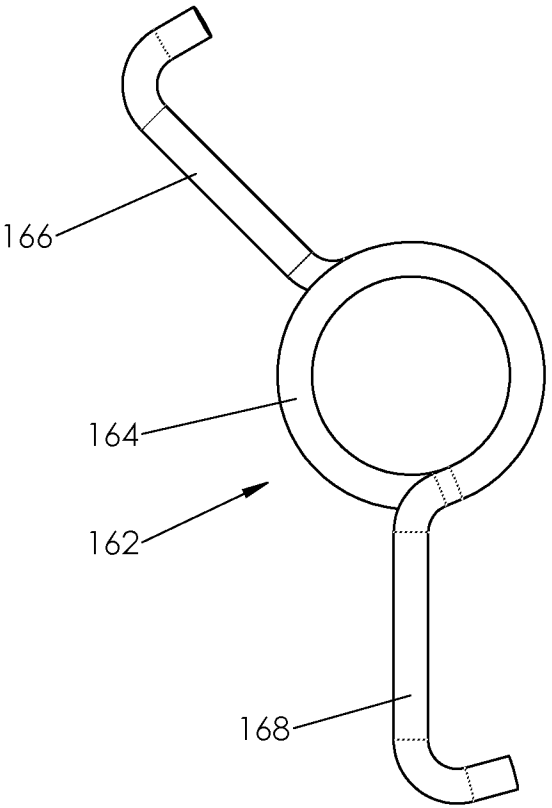
FIG. 32 is a front elevation view of the torsion return spring.
Figure 31:
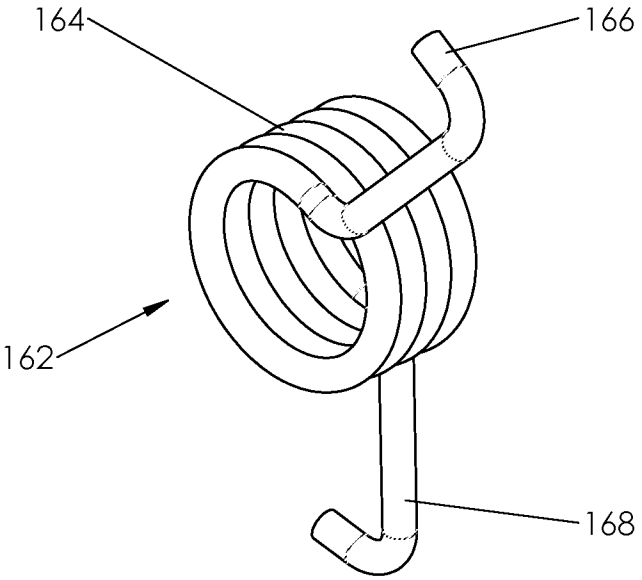
FIG. 31 is a perspective view of the torsion return spring.

FIGS. 31 and 32 illustrate the torsion return spring 162. It has a plurality of central coils 164 from which an upper leg 166 and a lower leg 168 extend radially. When the actuator is in a neutral position, the upper leg 166 rests against or immediately adjacent to, from the inside out: a) the end face 79 of the first spring retainer wall 78, b) the drive surface 144A of the LC input 38, and c) the drive surface 158A of the output gear 152. Similarly, when the actuator is in a neutral position, the lower leg 168 rests against or immediately adjacent to, from the inside out: a) the end face 81 of the second spring retainer wall 80, b) the drive surface 1448 of the LC input 38, and c) the drive surface 1588 of the output gear 152.

Figure 33:
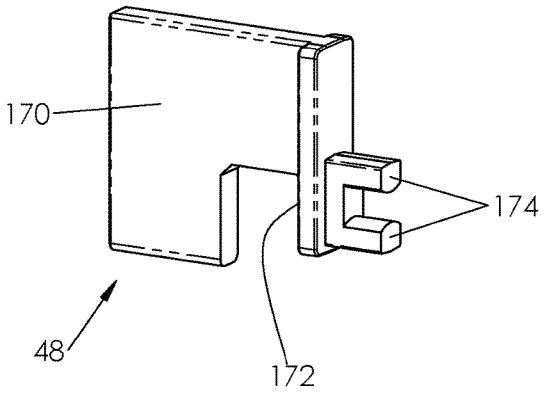
FIG. 33 is a perspective view of the switch actuator.

FIG. 33 illustrates the switch actuator 48. It has a main plate 170 with a cutout 172 providing clearance for the output gear 152. A pair of spaced fingers 174 define a cam follower that engages the cam surface 127 on the rear edge of the output latch's ring 126. The switch actuator's plate 170 slides up and down in between the rails 68 of the housing base 32. Such movement actuates an electrical switch to control the motor.

Figure 34:
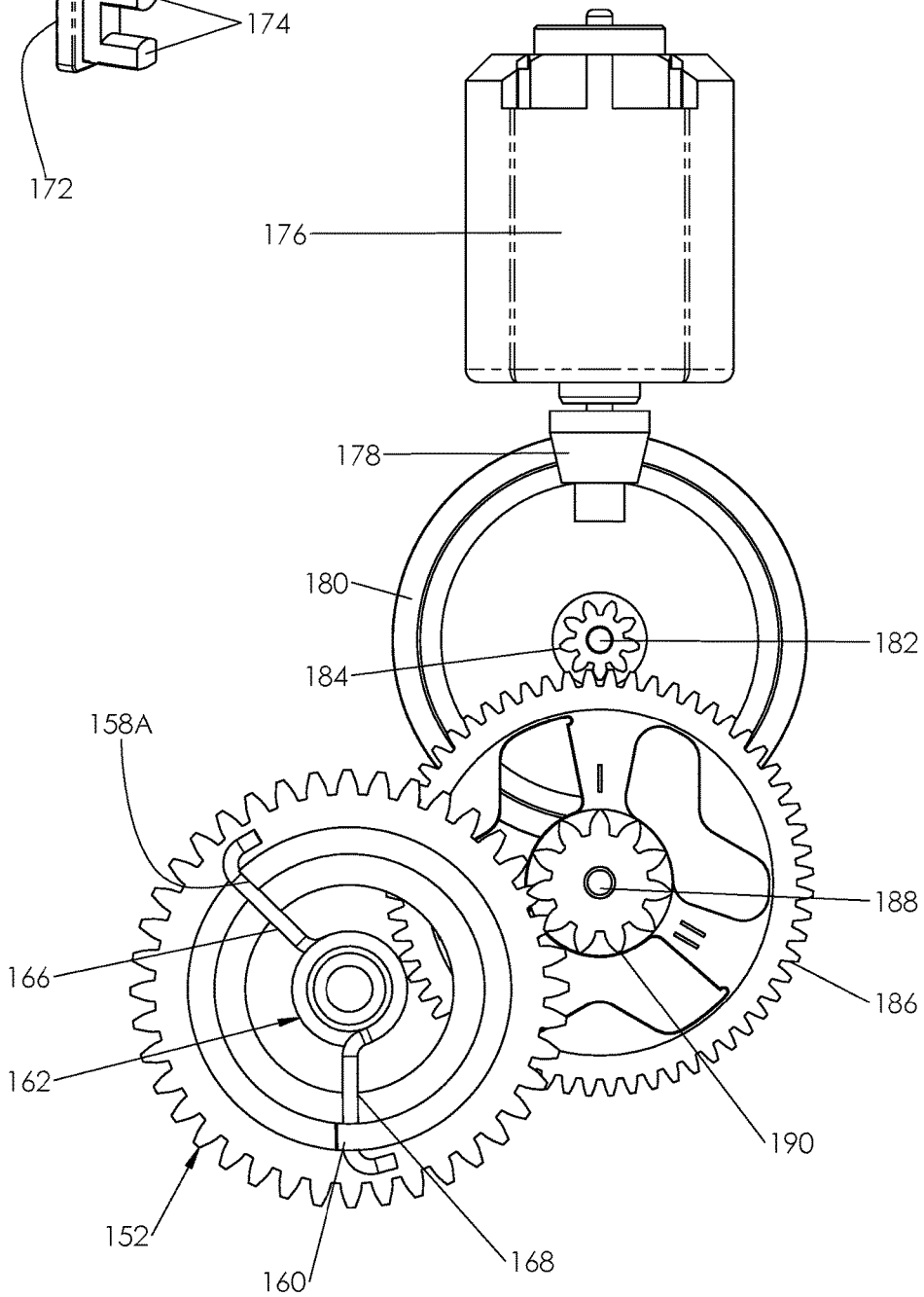
FIG. 34 is a front elevation view of the drive train, with the torsion return spring included.
Figure 35:
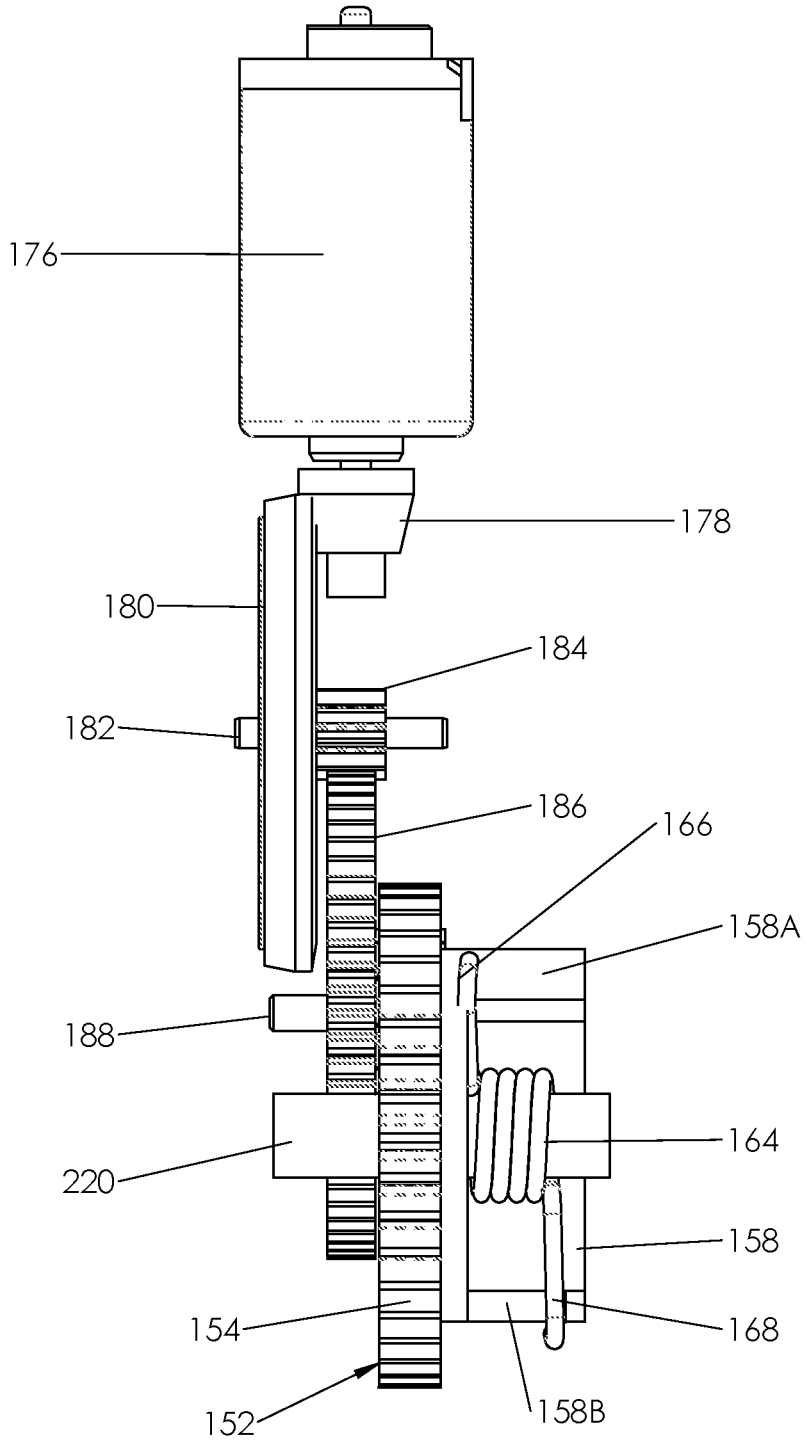
FIG. 35 is a left side elevation view of the drive train.
Figure 36:
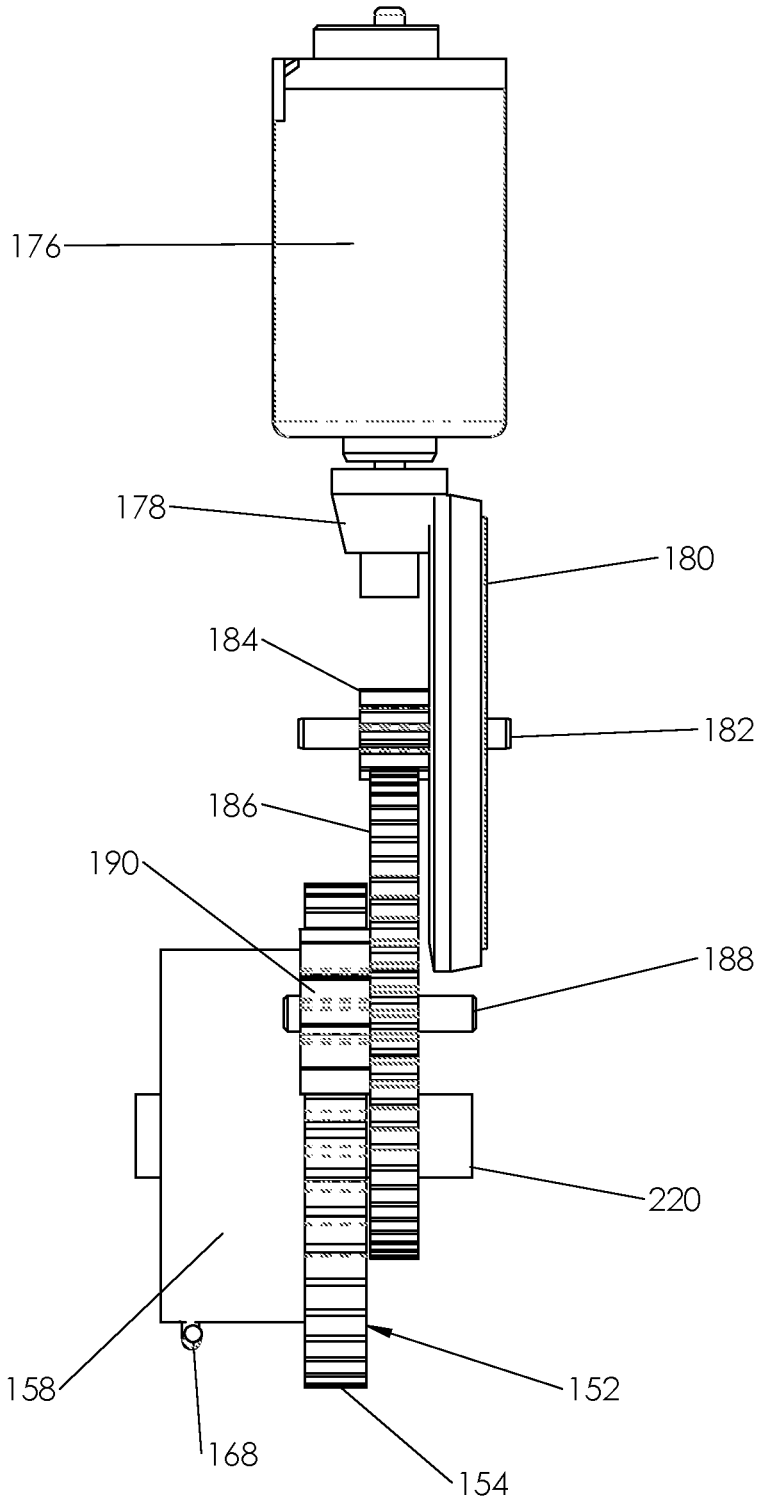
FIG. 36 is a right side elevation view of the drive train.

FIGS. 34-36 illustrate the components of the powered drive train. In addition to the output gear 152, the powered drive train includes a motor 176 mounted in the motor compartment 60 of the housing base 32. The motor shaft mounts a bevel pinion 178 that drives a bevel gear 180. The bevel gear is mounted on a shaft 182 that is supported in socket 64. The bevel gear is preferably integrally formed with a pinion 184 that meshes with a second spur gear 186. The second spur gear is mounted on a second shaft 188 that is supported in second shaft socket 66. The second spur gear carries a second pinion 190. The second pinion meshes with the spur gear 154.

Figure 40:
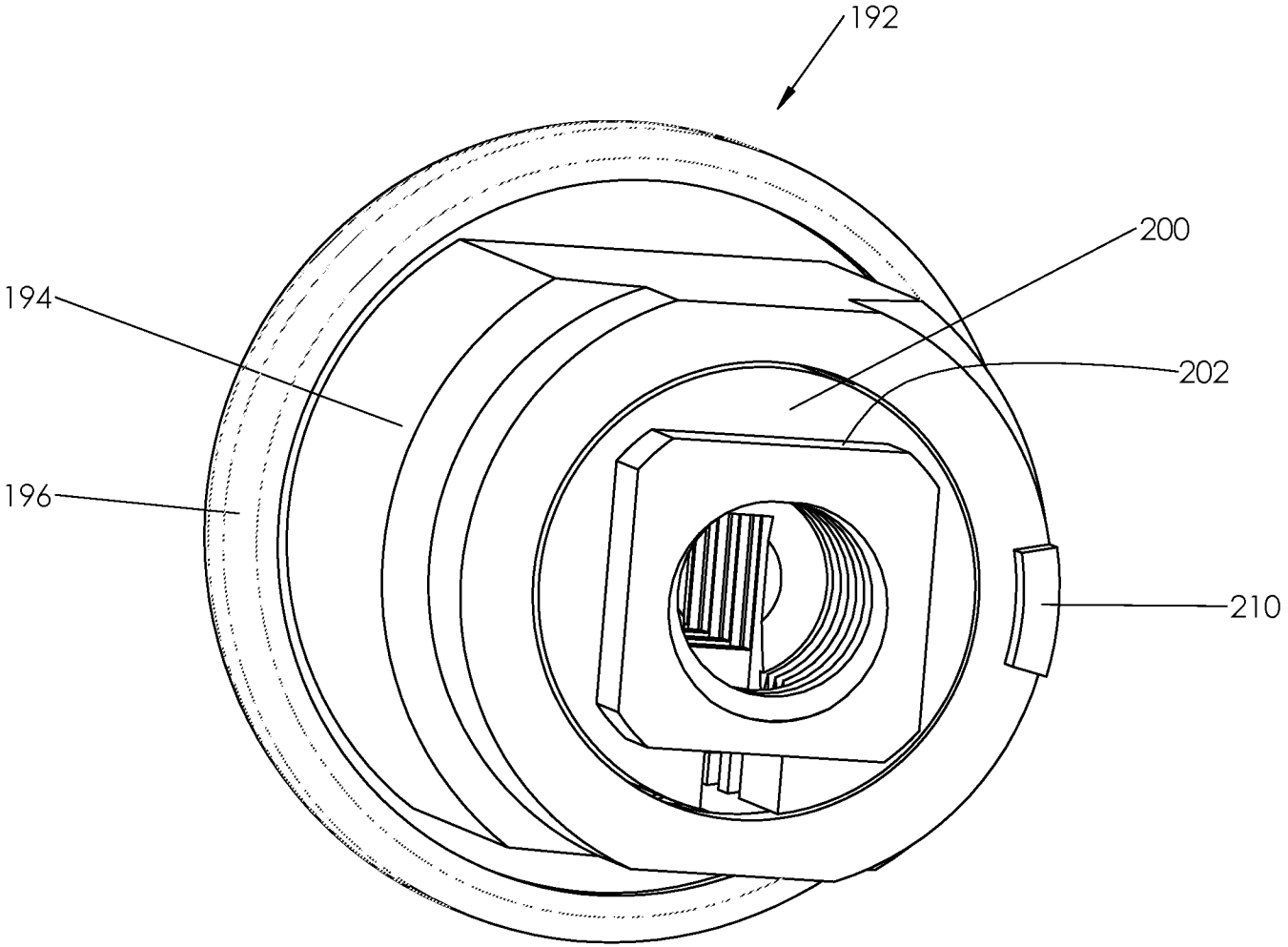
FIG. 40 is a perspective view of the lock cylinder.
Figure 40A:
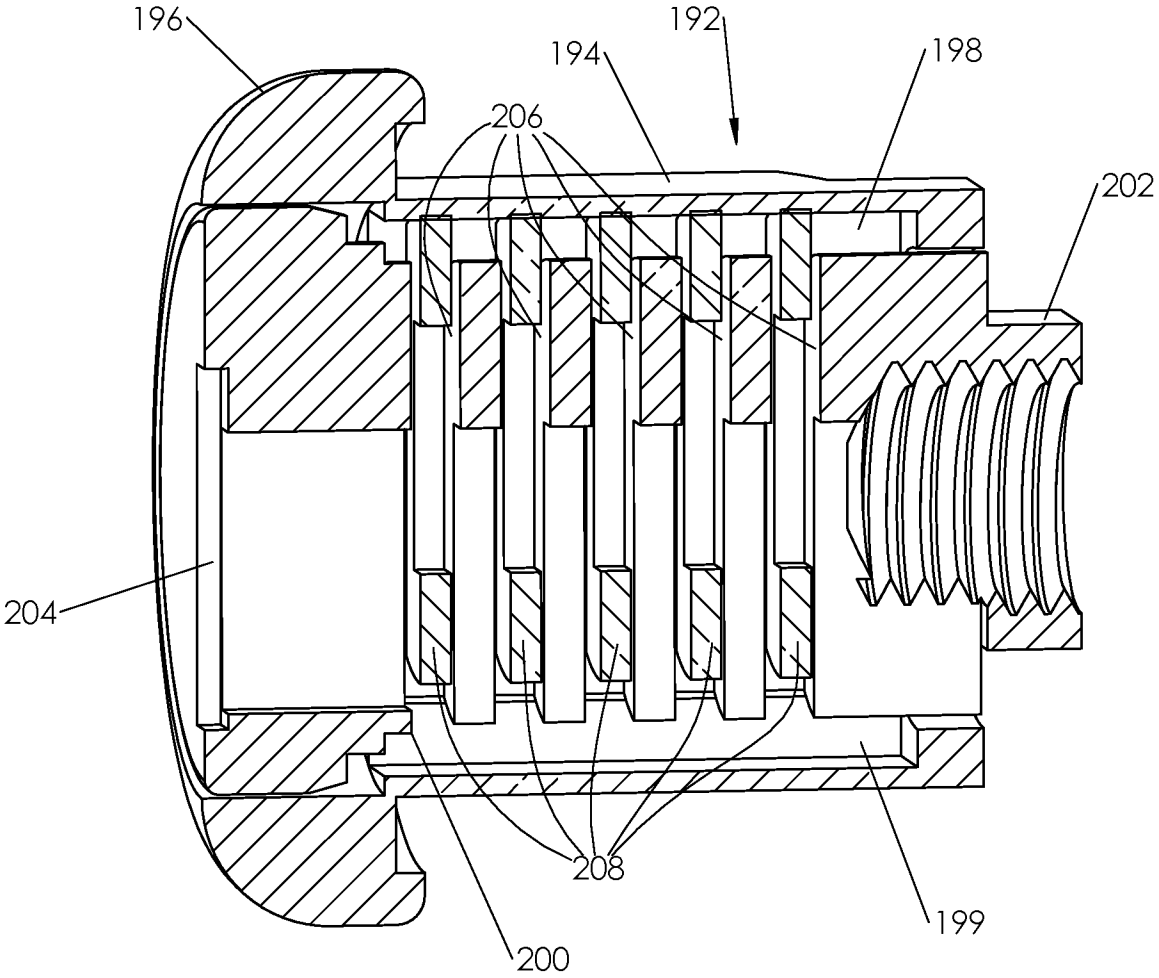
FIG. 40A is a longitudinal section through the lock cylinder.
Figure 40B:
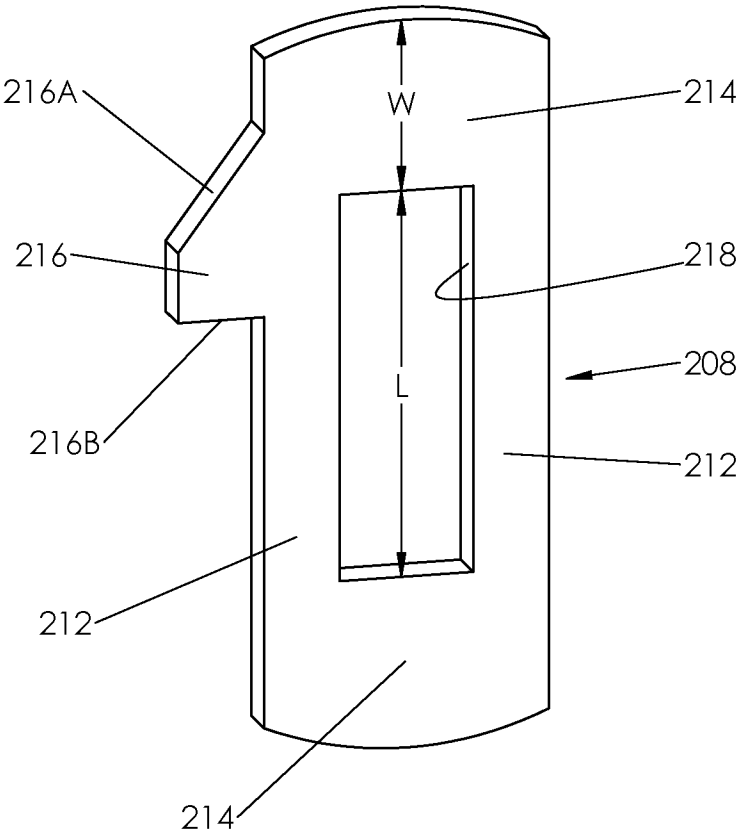
FIG. 40B is a perspective view of a lock tumbler.

Details of a suitable lock structure 192 are shown in FIGS. 40, 40A and 40B. The lock structure includes a hollow lock body 194 that includes a head 196. The head may be integrally formed with the body or otherwise connected thereto. In this embodiment the body has two openings or channels, shown at 198 and 199. The axes of the channels are spaced 180° from one another. The channels are sized to accept the lock tumblers, as explained below. Some lock designs include a third channel spaced 90° from the other two channels.

Mounted for rotation inside the body 194 is a cylindrical plug 200. The interior end of the plug 200 carries an octagonal projection 202. The projection 202 fits into the depression 108 of the LC adaptor's disc 104. This rotationally locks the plug 200 to the LC adaptor 36. Thus, the LC adaptor 36 rotates with the plug 200. The plug further defines a longitudinal slot 204 that receives a key (not shown). A series of transverse pockets 206 are also cut into the plug. In this embodiment there are five transverse pockets, although a different number could be used. A tumbler 208 and spring (not shown) are inserted into each transverse pocket 180.

Extending axially from interior end of the lock body 194 is a stud 210. The stud 210 fits in the C-shaped groove 110 of the LC adaptor 36 to limit the available rotation of the lock plug 200 and LC adaptor.

Details of a tumbler are shown in FIG. 40B. The tumbler is a flat plate defined by a pair of spaced apart legs 212 joined by two end pieces or cross members 214. One of the legs carries a tang 216 having an angled edge 216A and a straight edge 216B that is perpendicular to the adjoining leg 212. The spring in each transverse pocket 206 bears against the straight edge 216B of the tang 216 to bias the tumbler 208 radially. This spring biasing of the tumbler means that when there is no correct key in the plug 200 the spring will bias the tumbler into a channel 198 or 199, thereby preventing rotation of the plug. The outer edges of the end pieces 214 have an arc whose radius is the same as that of the plug 200. Further, the distance between the outer edges of the end pieces matches the diameter of the plug. Thus, when the tumbler is centered in the plug (which will only happen if there is a correct key in the longitudinal slot 204) the ends of the tumbler do not extend beyond the plug outer diameter and the tumbler will not interfere with rotation of the plug 200 in the lock body 194. However, when the tumbler is adjacent one of the channels and is not centered in the plug by a correct key, it will enter the channel. As just mentioned, when this happens engagement of the tumbler with the body then prevents further rotation of the plug.

The legs 212 and end pieces 214 define a tumbler passage 218 that is aligned with the longitudinal slot 204. Thus, a key inserted into the longitudinal slot 204 fits through the tumbler passages 218 as well. The bitting of the key, i.e., the series of protrusions and valleys on an edge of the key, will engage one of the inner edges of an end piece 214. The distance between the outer edge and inner edge of the end piece will be called an end piece width. It is indicated at W in FIG. 40B. The end piece widths of the various tumblers differ. As a result of the differing end piece widths the lengths of the tumbler passages (L in FIG. 40B) differ. To enable the plug to rotate, all of the tumblers must be centered in the plug. This means a key having the correct bitting to match the end piece widths and locate the tumbler in the center of the plug must be inserted to get the tumblers out of the channels. If the key bitting is a mismatch the bitting will either push the tumbler into one channel, or allow the tumbler spring to push the tumbler into the other channel. Either way, a tumbler disposed in one of the channels will prevent rotation of the plug.

This is conventional operation of a cylinder lock. Those skilled in the art will understand that numerous alternative arrangements of the plug, body and tumblers are possible to achieve similar results. It is pointed out that a key can only be withdrawn from the plug when the tumblers are aligned with a body channel. This is because to get the key out the bitting of the key must slip past all the tumblers on its way out. For that to happen the tumblers must be free to move radially out of the way. They cannot do that when the tumblers are adjacent the inside wall of the body 194; they must be adjacent a channel 198, 199. Accordingly, when the key is withdrawn from the longitudinal slot, the tumblers will always be aligned with a channel and the tumbler springs will all bias the tumblers into that channel and will always prevent further rotation of the plug. This means that if there are 90° spaced-apart body channels, there is a potential for the user to leave the plug in a condition that would prevent subsequent actuation of the actuator assembly by the powered drive system. In other words, depending on the linkage between the manual drive and the latch, the manual drive could be placed by a user in a position where it would prevent the powered drive from moving the locking rod. One way to prevent this is to alter the location of the channels in the lock body, or alternately to fill in a channel with some type of insert. Removal or filling a channel would prevent the key from being removed in an undesirable orientation. That is, the user would always be required to return the plug to a neutral position before he or she could withdraw the key. Because it is undesirable in a retrofit installation to require alteration of the existing lock structure, the present invention takes a different approach to this problem. It prevents the plug from reaching an undesired body channel location in a manner that will be described below.

The remaining components of the actuator assembly are shown in FIG. 37. These include an output tube 220 that fits through the bore of the inner sleeve 72 of the mandrel 70. The output tube 220 also receives thereon the bore 142 through the hub 140 of the LC input 38. The machine screw 44 fits through the output tube with the head of the machine screw resting in the counterbore 77 under the inner sleeve 72. There is also a washer 222 between the boss 112 of the LC adaptor 36 and the hex head 114 of the cap screw 46. The switch actuator 48 is well shown in FIG. 37, as is the electrical switch 98. The printed circuit board 94 fits inside the housing cover 34. The printed circuit board may include appropriate electrical connectors.

Figure 41:
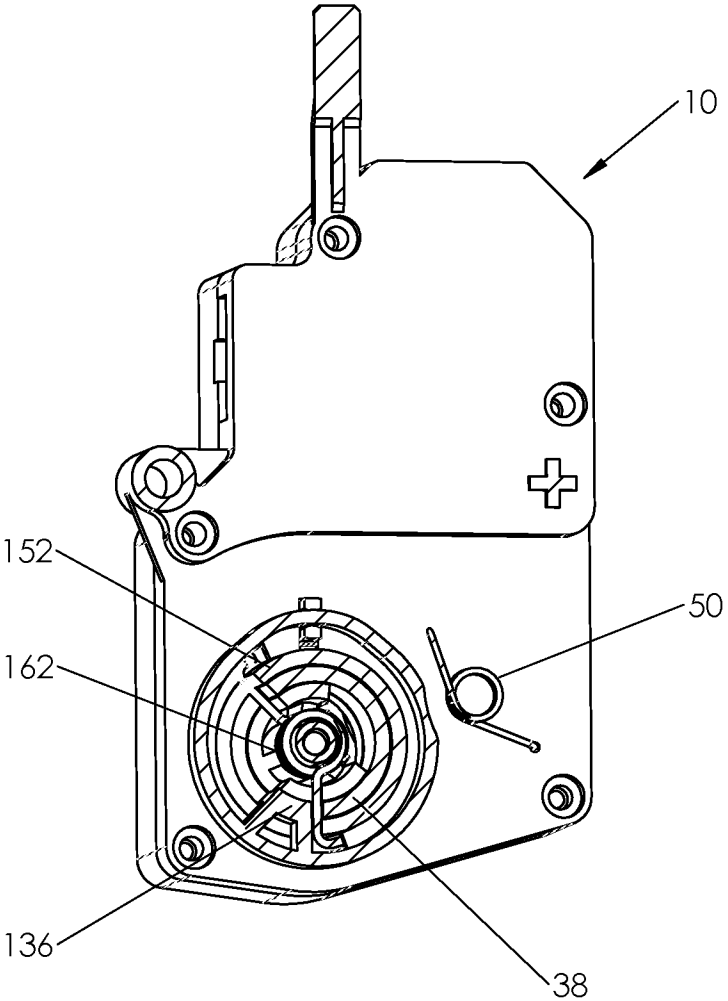
FIG. 41 is a section taken generally along line 41-41 of FIG. 1A.

As can be seen in FIG. 41, the arrangement of the drive surfaces is such that they can only push the drive wedge 136 in front of the drive surface; they cannot pull the drive wedge. That is, the first drive surfaces 144A, 158A can only push the drive wedge 136 counterclockwise. They cannot pull it clockwise. Similarly, the second drive surfaces 1448, 1588 can only push the drive wedge 136 clockwise but they cannot pull the drive wedge 136 counterclockwise. It will also be noted in FIG. 41 that the radial extent of the drive wedge 136 is such that it spans at least the radial locations of the first and second drive surfaces. Optionally, the drive wedge 136 may extend radially beyond the drive surfaces and past the outside diameter of the first and second spring retainer walls 78, 80, as shown in FIG. 41. The radial extent of the drive wedge 136 assures that upon operation of the actuator the return spring legs 166, 168 are always trapped directly between the drive surfaces 144A, 144B, 158A and 158B. That is, there is always at least a portion of the drive wedge in the path of movement of a drive surface. As a result of this geometry the drive surfaces are incapable of applying a bending force to a spring leg that could potentially wrap a spring leg around the drive wedge.

The use, operation and function of the actuator assembly are as follows. As mentioned above, it is an object of this invention to lock and unlock the device either manually or electrically. Regardless of whether the previous actuation was a locking or unlocking motion, electric or manual, the actuator must be capable of performing the next actuation either manually or electrically, as determined by the user. Turning to FIG. 41, the latch output 40 and its drive wedge 136 are shown in a first position. In this orientation the latch output 40 has positioned the output cam 40 in a first position. Looking just underneath the latch output's internal flange 128 and the LC input's hub 140, the drive surfaces 158A, 1588 of the output gear 152 would be positioned as shown in FIG. 41. Similarly, the drive surfaces 144A, 144B of the LC input 38 would be positioned as shown. And the end faces 79, 81 of the first and second spring retainer walls 78, 80 of the mandrel 70 would have the indicated orientation. Likewise, the upper leg 166 of the torsion return spring 162 would extend radially adjacent to, from inside to outside, the end face 79 of the mandrel 70, the LC input drive surface 144A, and the output gear drive surface 158A. The lower leg 168 of the torsion return spring 162 would extend radially adjacent to, from inside to outside, the end face 81 of the mandrel 70, the LC input drive surface 144B, and the output gear drive surface 1588. The drive wedge 136 of the latch output 40 is located, in this instance, adjacent the LC input drive surface 1448 and the output gear drive surface 1588, with the lower leg 168 of the return spring 162 intervening. These will be called a neutral position of the drive surfaces and a first position of the drive wedge 136. The next actuation would move the drive wedge 136, latch output 40 and output cam 42 to a second position, in this case either a locked or unlocked condition that is the opposite of the first position. This is done in a forward movement of a drive surface 1448 or 1588, which in turn rotates the drive wedge 136, latch output 40, and thereby moves the output cam 42 to a new position.

The output cam 42 can be moved by either the manual or powered drive system. Consider first a powered move from the first to the second position. A user activates an electrical switch that provides electric power to the motor 176. The motor shaft turns, causing the bevel gear 180 to rotate, which in turn causes the pinion 184 and second spur gear 186 to rotate. The second pinion 190 on the second spur gear 186 drives the output gear 152. Rotation of the output gear 152 causes the C-shaped wall 158 to rotate, in this case clockwise as seen in FIG. 41. The first drive surface 1588 contacts the lower leg 168 of return spring 162 and drives it clockwise. Movement of the return spring lower leg 168 immediately causes the drive wedge 136 on the latch output 40 to move clockwise, thereby rotating the output cam 42 and its pin 120. The locking link 26 translates with the pin 120. As the output cam 40 starts to move it initially compresses the legs of the bi-stable spring 50 together. This compression continues until the axis of rotation of the output cam (i.e., the center of opening 122), the hole in bracket 132 (which mounts one leg of the bi-stable spring to the latch output 40) and the hole 88 (which mounts the other leg of the bi-stable spring to the cover 34) are aligned with one another. Once the bracket 132 passes through that center position, the bi-stable spring begins to de-compress by pushing the latch output 40 to the second position where the drive wedge 136 is adjacent the first drive surfaces 144A, 158A and the end face 79 of first spring retainer wall 78. Thus, the drive motor must initially overcome the resistance of the bi-stable spring in driving the drive surface to its forward position and the output cam toward its second position. But once the cam move is halfway completed, the bi-stable spring will assist the motor in finishing the move. In a preferred embodiment there is a controller in the electrical circuit that receives an input from the electrical switch 98 to turn off the motor before it stalls in the full thrown position. The switch 98 is activated by the switch actuator 48 and its reaction to the cam surface 127 of the output latch 40. Alternately, the switch may be deleted. In this case it is cheaper not to install a printed circuit board either. The incoming wires are connected directly to the motor. An external controller may issue a finite duration pulse to the actuator motor (typically a 300 to 1000 milliseconds duration). This is long enough to assure pushing the bi-stable spring through its center position but not so long as to stall the motor in a fully thrown position.

The drive motor, and eventually the bi-stable spring, must also overcome the resistance of the return spring. Note in FIG. 41 that for the drive surface 144B or 158B to reach the second position, the return spring coils 164 must be wound or compressed. By time the move is finished, power to the motor has been cut off. The return spring 160 will then drive the output gear 152 or LC input 38 back from the second position to its starting, neutral position, as seen in FIG. 41. Thus, the output gear or LC input returns to its neutral position but the drive wedge 136 is left in its second position. Alternately, power to the motor could be reversed after the forward move, in which case the return spring 162 would merely assist the motor in causing the output gear or LC input to return to the neutral position.

Suppose the next move from the second position is a manual actuation. This could be considered a reverse move of drive surface 144A resulting in return of the output cam to its first position. The user puts the key in the longitudinal slot 204 of the lock plug 200. The bitting of the key removes all of the tumblers 208 from any channel 198,199 of the lock body 194, thus freeing the plug 200 for rotation. When the user turns the key the plug 200 rotates with the key, causing the LC adaptor 36 to rotate since the plug's projection 202 is engaged with the LC adaptor's depression 108. The drive surface 144A engages the return spring drive leg 166 which in turn engages the drive wedge 136. Once again counter-clockwise movement of the drive wedge 136 creates rotation of the latch output 40 and the output cam's pin 120 and the locking link 26. The user's rotation also compresses the return spring 162 and initially compresses the bi-stable spring 50. Rotation of the LC adaptor 36 also causes rotation of the C-shaped groove 110 relative to the stud 210 of the lock structure 192. Because the stop faces of the LC adaptor's groove 110 contact the stud 210, the user cannot rotate the LC adaptor shaft, and consequently the lock plug 200, to a position where the tumblers will align with a 90° offset channel. Thus, as explained above, the user will not be able to withdraw the key with the plug in a rotated position. The only way to withdraw the key is to return the plug, and therefore the adaptor shaft, to the starting, neutral position. But once the user rotates the plug half way from the neutral position toward the alternate position (in this case the output cam is moving toward its first position), the bi-stable spring 50 will take over and finish the movement of the output cam. Meantime, the user's return of the plug to the neutral position will be assisted by the return spring 162. The parts end up in the condition of FIG. 41. It can be seen that the use of the rotation limiting device afforded by the stud 210 and groove 110, plus the bi-stable spring, allows the user to manually execute either a forward or reverse movement of the lock plug but not leave it in a condition which would prevent a subsequent powered actuation.

While the foregoing description covered a powered forward move and a manual reverse move, obviously the move in either direction could be manual or powered. A manual forward move would start with the parts as shown in FIG. 41. Then the LC input's drive surface 1448 would move clockwise, pushing drive wedge 136 before it and causing the pin 120 to move more than halfway to the second position. The output cam rotation to the second position would be finished by the bi-stable spring. The user would have to return the LC adaptor 36 to the neutral position of FIG. 41 to get the key out. That return motion would be assisted by the return spring 162.

The final motion to be described would be a powered reverse motion. This would start with the drive wedge 136 in the second position adjacent drive surfaces 144A, 158A. The motor is activated by a switch thrown by the user. The motor starts and causes the drive train to move the drive surface 158A from its neutral position of FIG. 41 toward a reverse position wherein the drive surface 158A is rotated counterclockwise toward second spring retainer wall 80. Again, drive surface 158A picks up drive leg 166 which contacts drive wedge 136, causing the output cam 42 to rotate. This motion also causes compression of the bi-stable spring until the output cam is halfway or so to its first position at which point the bi-stable spring starts to unwind and assist the motor with completing the move of the output cam to its first position. During movement of the drive surface 158A return spring leg 166 is being wound. Upon deenergization of the motor the spring 162 will cause return of the output gear from its reverse position to its neutral position, leaving the drive wedge 136 moved to its first position as in FIG. 41.

FIG. 41 illustrates that due to the inner diameter of the C-shaped wall 144 of the LC input 38 being equal to or, in this case, somewhat less than the inner diameter of the drive wedge 136, there is no possibility of damaging the torsion spring legs 166, 168 even in the event that an overzealous user provides excessive torque to the key during an attempted manual actuation of the lock. Such excessive torque will simply compress the spring leg between a drive surface 144A or 144B and the drive wedge. But because of the arrangement of the diameters of the C-shaped wall 144 and the drive wedge 136, there is always at least a portion of the drive wedge in the path of movement of the drive surface and thus no damage can occur. It will also be noted that while movement of one of the drive surfaces 144A, 144B and 158A, 158B causes movement of the drive wedge 136, the drive surfaces do not actually contact the drive wedge directly because a spring leg 166 or 168 always intervenes between the drive wedge and the drive surface. Nevertheless, the drive wedge is engageable with a drive surface through the spring leg to cause movement of the drive wedge and the actuating member in the form of the latch output 40.

Figure 43:
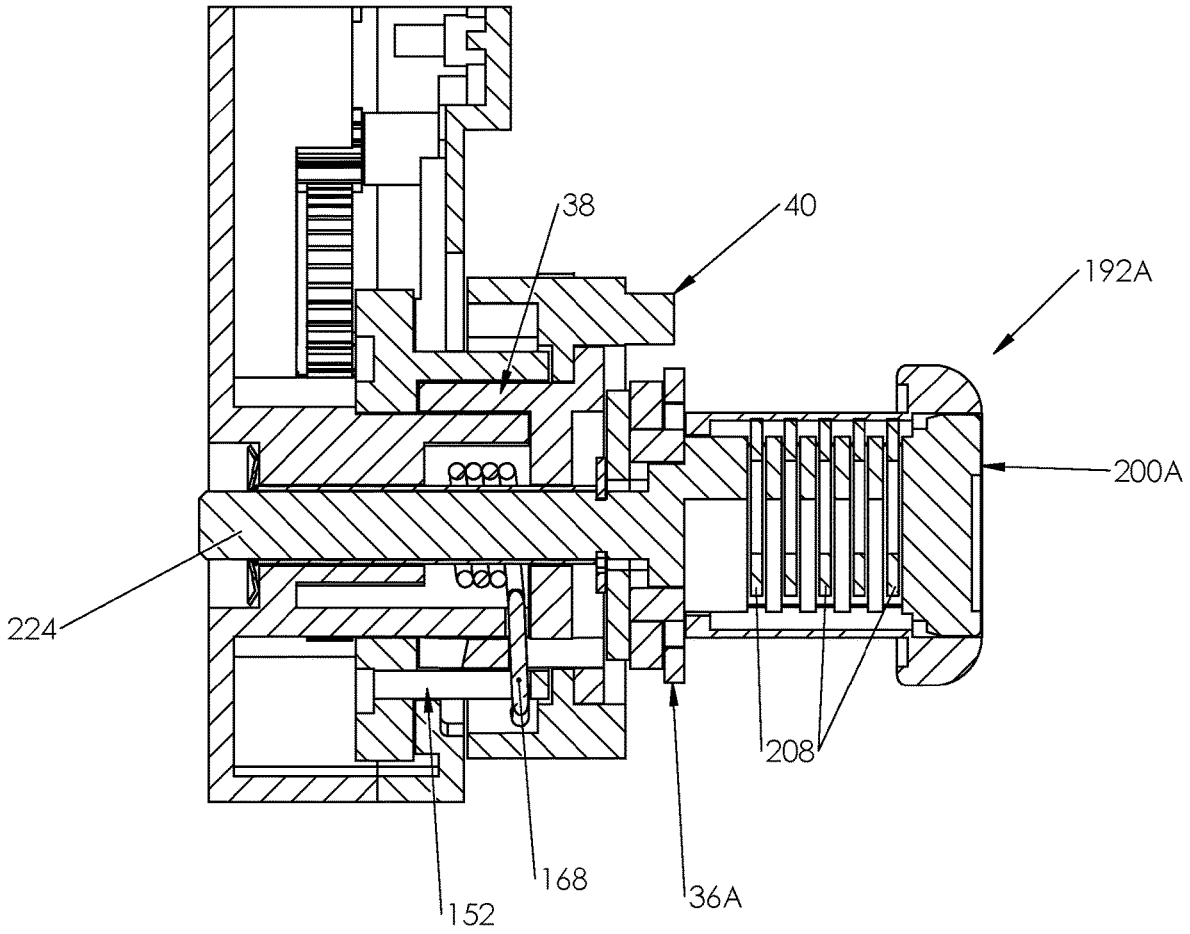
FIG. 43 is a section similar to FIG. 37 showing an alternate form of the lock cylinder plug.

FIG. 43 illustrates an alternate embodiment with a revised lock structure 192A. This version has an alternate cylinder plug 200A. It has an extending post 224 that replaces the machine screw 44 and cap screw 46, resulting in fewer parts. An alternate lock cylinder adaptor 36A is also used in this version. The other parts are the same or essentially the same as in the previous embodiment.

It will be appreciated that various modifications and changes may be made to the above described preferred embodiment of a locking device having a manual and powered actuator without departing from the scope of the following claims. For example, although the devices disclosed herein have been shown in regard to a paddle lock, the teachings of this invention may be extended to other locks and locking mechanisms.

The invention claimed is:

1. An actuator assembly for manual or powered actuation of a lock mechanism of the type having a lock plug and a locking member, the actuator assembly comprising:

a housing;

a motor and powered drive train mounted in the housing and the powered drive train being engaged with the motor;

the locking member mounted for rotatable movement relative to the housing;

an actuating member rotatably connected to the housing, connected to and concentric with the locking member and movable between first and second positions;

a manual drive member connected to the lock plug and having first and second drive surfaces spaced apart from one another, the manual drive member rotatably connected to the housing for movement between neutral, forward and reverse positions;

a powered drive member having first and second drive surfaces spaced apart from one another, the powered drive member rotatably connected to the housing and being concentric with the manual drive member for movement between neutral, forward and reverse positions, the powered drive member being part of the powered drive train;

the actuating member having at least one drive portion disposed intermediate the spaced apart first and second drive surfaces of the manual drive member and intermediate the spaced apart first and second drive surfaces of the powered drive member, the at least one drive portion being connected to the actuating member and being drivable by the first drive surface of the manual drive member and by the first drive surface of the powered drive member for moving the actuating member from said first position toward said second position upon movement of the manual drive member or the powered drive member from the respective neutral position to the forward position, the at least one drive portion being drivable by the second drive surface of the manual drive member and by the second drive surface of the powered drive member for moving the actuating member from said second position toward said first position upon movement the manual drive member or the powered drive member from the respective neutral position to the reverse position;

the at least one drive portion always being located in a path of movement of at least one of the respective first and second drive surfaces of at least one of the respective manual drive member and the powered drive member;

wherein rotational movement of the manual drive member or the powered drive member causes rotational movement of the actuating member which causes rotational movement of the locking member.

2. The actuator assembly of claim 1 further comprising a return spring, wherein the return spring biases the manual and powered drive members to the respective neutral positions.

3. The actuator assembly of claim 2 wherein the return spring further comprises at least two spring legs, wherein each spring leg is disposed between the at least one drive portion of the actuating member and at least one of the respective first and second drive surfaces of at least one of the respective manual and powered drive members.

4. The actuator assembly of claim 1 further comprising a bi-stable spring connected to the actuating member and to the housing, and wherein the bi-stable spring biases the actuating member toward a respective selected first or second position.

5. An actuator assembly for manual or powered actuation of a lock mechanism of the type having a lock plug and a locking member, the actuator assembly comprising:

a housing;

a motor and powered drive train mounted in the housing and the powered drive train being engaged with the motor;

a manual drive member rotatably connected to the housing for movement between forward and reverse positions, the lock plug being connected to the manual drive member;

a powered drive member being rotatably connected to the housing concentric with the manual drive member for movement between forward and reverse positions, the powered drive member being part of the powered drive train;

said manual and powered drive members each having respective first and second drive surfaces spaced apart from one another;

an actuating member rotatably connected to the housing and driven by the respective manual or powered drive member to move said locking member between first and second positions; and the actuating member having at least one drive portion disposed intermediate the respective first and second drive surfaces of each of the respective manual and powered drive members, the drive portion extending from the actuating member such that selective rotation of one of said respective manual or powered drive members moves the actuating member and connected locking member between first and second positions;

the at least one drive portion always being located in a path of movement of at least one of the respective first and second drive surfaces of at least one of the respective manual and powered drive members.

6. The actuator assembly of claim 5 wherein the forward and reverse positions of the manual drive member are spaced from the second and first positions, respectively, of the actuating member such that the manual drive member can drive the actuating member only partially from one position to the other, and further comprising a bi-stable spring connected to the housing and the actuating member to bias the actuating member to one of said first or second positions, whereby the bi-stable spring will complete the driving of the actuating member from one position to the other as begun by the manual drive member.

7. The actuator assembly of claim 5 further comprising a switch actuator slidably received by the housing and being driven by the actuating member, the switch actuator interacting with an electrical switch that is connected to the motor controller.

8. The actuator assembly of claim 7 further comprising a printed circuit board mounted in the housing and being connected the electrical switch.

9. The actuator assembly of claim 5 wherein the respective manual and powered drive members each have a neutral position.

10. The actuator assembly of claim 9 further comprising a return spring, wherein the return spring biases the manual and powered drive members to the respective neutral positions.

11. The actuator assembly of claim 10 wherein the return spring further comprises at least two spring legs, wherein each spring leg is disposed between the at least one drive portion of the actuating member and at least one of the respective first and second drive surfaces of at least one of the respective manual and powered drive members.

* * * * *